US006814507B2

(12) United States Patent
Inagaki

(10) Patent No.: US 6,814,507 B2
(45) Date of Patent: Nov. 9, 2004

(54) SUBSTRATE TREATING APPARATUS

(75) Inventor: Yukihiko Inagaki, Kyoto (JP)

(73) Assignee: Dainippon Screen Mfg. Co., Ltd. (JP)

( * ) Notice: Subject to any disclaimer, the term of this patent is extended or adjusted under 35 U.S.C. 154(b) by 0 days.

(21) Appl. No.: 10/394,313

(22) Filed: Mar. 20, 2003

(65) Prior Publication Data

US 2003/0185561 A1 Oct. 2, 2003

(30) Foreign Application Priority Data

Mar. 28, 2002 (JP) ..... 2002-090539

(51) Int. Cl.[7] ..... G03D 7/00

(52) U.S. Cl. ..... 396/571; 396/611; 355/30; 414/935; 414/940

(58) Field of Search ..... 396/604, 611; 355/27–30; 118/52; 414/935, 940

(56) References Cited

U.S. PATENT DOCUMENTS

| | | | | |
|---|---|---|---|---|
| 5,015,177 A | 5/1991 | Iwata | ..... | 432/121 |
| 5,651,823 A | 7/1997 | Parodi et al. | ..... | 118/500 |
| 5,935,768 A | 8/1999 | Biche et al. | ..... | 430/401 |

*Primary Examiner*—D. Rutledge
(74) *Attorney, Agent, or Firm*—Ostrolenk, Faber, Gerb & Soffen, LLP

(57) ABSTRACT

A substrate treating apparatus includes a heat-treating unit having a cooling unit and a local transport mechanism. The local transport mechanism, in time of standby, is placed in a standby position inside the cooling unit. The local transport mechanism in the standby position influences, and is influenced by, the environment outside the heat-treating unit less than where the local transport mechanism is kept on standby outside the heat-treating unit. Variations in substrate treating precision due to such adverse influences are reduced to perform substrate treatment with high precision.

20 Claims, 16 Drawing Sheets

SUBSTRATE TREATING APPARATUS

BACKGROUND OF THE INVENTION (1) Field of the Invention

This invention relates to a substrate treating apparatus for performing a series of treatments of substrates such as semiconductor wafers, glass substrates for liquid crystal displays, glass substrates for photomasks, and substrates for optical disks (hereinafter called simply substrates).

(2) Description of the Related Art

Conventionally, such a substrate treating apparatus is used, for example, in a photolithographic process for forming photoresist film on substrates, exposing the substrates having the photoresist film formed thereon, and developing the exposed substrates.

This apparatus will be described with reference to a plan view shown in FIG. 1. This substrate treating apparatus includes an indexer 103 having a cassette table 101 for receiving a plurality of cassettes C each containing a plurality of (e.g. 25) wafers W to be treated, or wafers W having been treated in treating units 104 described hereinafter, and a transport mechanism 108*a* movable horizontally along the cassettes C for transporting the wafers W between the cassettes C and treating units 104. The apparatus further includes, besides the treating units 104, a main substrate transport path 105 along which the wafers W are transported from one treating unit 104 to another, and an interface 106 for transferring the wafers W between the treating units 104 and an external treating apparatus 107.

The external treating apparatus 107 is an apparatus separate from the substrate treating apparatus, and is detachably attached to the interface 106 of the substrate treating apparatus. Where the substrate treating apparatus is designed for resist application and development as noted above, the external treating apparatus 107 is an exposing apparatus for exposing the wafers W.

The substrate treating apparatus further includes a main transport mechanism 108*b* movable along the main substrate transport path 105, and a transport mechanism 108*c* movable along a transport path of the interface 106. In addition, a table 109*a* is disposed at a connection between the indexer 103 and main substrate transport path 105, and a table 109*b* at a connection between the main substrate transport path 105 and interface 106.

The above substrate treating apparatus performs substrate treatment through the following procedure. The transport mechanism 108*a* takes one wafer W out of a cassette C containing wafers W to be treated, and transports this wafer W to the table 109*a* to pass the wafer W to the main transport mechanism 108*b*. The main transport mechanism 108*b*, after receiving the wafer W placed on the table 109*a*, transports the wafer W into each treating unit 104 for a predetermined treatment (e.g. resist application) in the treating unit 104. Upon completion of each predetermined treatment, the main transport mechanism 108*b* takes the wafer W out of the treating unit 104, and transports the wafer W into another treating unit 104 for a next treatment (e.g. heat treatment).

The plurality of treating units 104 include those for performing heat treatment (hereinafter called "heat-treating units" as appropriate). Some heat-treating units 104 perform, for example, heat treatment after resist application for heat-treating the wafers with photoresist film formed thereon, and other heat-treating units 104 perform heat treatment after exposure for heat-treating the wafers having undergone an exposing process to be described hereinafter. Each heat-treating unit 104 has a hot plate for heating wafers W and a cool plate for cooling the wafers W having been heated, the two plates being arranged one above the other, and a local transport mechanism separate from and independent of the main transport mechanism 108*b* for transporting the wafers W between the hot plate and cool plate.

The local transport mechanism is provided for each heat-treating unit separately from the main transport mechanism 108*b* for the following reasons. For the two types of heat treatment after resist application and after exposure noted above, the time taken after a fixed time of heating by the hot plate until the cooling treatment by the cool plate is extremely important from the processing point of view. Variations in that time (i.e. cooling starting time after the heating treatment) would cause variations in film thickness after the resist application or variations in line-width uniformity after the development. If, for example, the main transport mechanism 108*b* transported the wafer W also between the hot plate and cool plate in each heat-treating unit, it would be difficult to cool, immediately after heating, all of the wafers successively loaded for treatment, because of the time taken in transport to other treating units 104 and the time taken in treatment in other treating units 104. This would result in a so-called overbaking or variations in the cooling starting time after the heating treatment. Thus, the independent local transport mechanism is provided separately from the main transport mechanism 108*b* to ensure a fixed cooling starting time after the heating treatment.

Further, if the same main transport mechanism were used to transfer wafers to and from the hot plate, the main transport mechanism would become heated and inadvertently apply heat to the wafers. This would affect treatment in other treating units 104 such as resist application and development. The independent local transport mechanism is provided to avoid such an inconvenience also.

After the series of pre-exposure treatment is completed, the main transport mechanism 108*b* transports the wafer W treated in the treating units 104 to the table 109*b*, and deposits the wafer on the table 109*b* to pass the wafer W to the transport mechanism 108*c*. The transport mechanism 108*c* receives the wafer W placed on the table 109*b* and transports the wafer W to the external treating apparatus 107. The transport mechanism 108*c* loads the wafer W into the external treating apparatus 107 and, after a predetermined treatment (e.g. exposure), takes the wafer W out of the external treating apparatus 107 to transport it to the table 109*b*. Subsequently, the main transport mechanism 108*b* transports the wafer W to the treating units 104 where a series of post-exposure heating and cooling treatment and development is performed. The wafer W having gone through all the treatment is loaded by the transport mechanism 108*a* into a predetermined cassette C. The cassette C is transported away from the cassette table 101 to complete a series of substrate treatment.

The conventional apparatus having such a construction has the following drawback.

The conventional substrate treating apparatus has the local transport mechanism in each heat-treating unit for transporting the wafer W between the hot plate and cool plate to secure a fixed cooling starting time after heating treatment as noted above. In this way, an effort is made for improvement in substrate treating precision. However, variations still occur in substrate treating precision; substrates cannot be treated with high precision.

SUMMARY OF THE INVENTION

This invention has been having regard to the state of the art noted above, and its object is to provide a substrate treating apparatus for treating substrates with high precision.

To solve the problem noted above, Inventor has made intensive research and attained the following findings. In the conventional substrate treating apparatus, the local transport mechanism of the heat-treating unit is provided for transporting wafers W between the hot plate and cool plate. The local transport mechanism accesses the hot plate or cool plate in time of wafer transport, and stands by outside the hot plate and cool plate at other times. That is, the local transport mechanism of the heat-treating unit has a standby position set outside the hot plate and cool plate, and stands by in the environment outside the heat-treating unit after transporting a wafer to the hot plate or cool plate. Thus, not only is the local transport mechanism easily affected by the influence (e.g. thermal influence) of the environment outside the heat-treating unit, but, conversely, the local transport mechanism exerts an influence (e.g. thermal influence) on the environment outside the heat-treating unit. It has been found that the influence on the local transport mechanism of the environment outside the heat-treating unit and vice versa are in a causal relationship with variations in substrate treating precision and a lowering of treating precision of the substrate treating apparatus.

Based on the above findings, this invention provides a substrate treating apparatus for performing a series of treatments on a substrate, comprising a heat-treating unit for heat-treating the substrate, and a main transport device for transferring the substrate between the heat-treating unit and a different unit, the heat-treating unit including a plurality of substrate treating sections arranged vertically, and a local transport device provided separately from the main transport device for transferring the substrate between the substrate treating sections, one of the substrate treating sections providing a standby position for the local transport device.

According to the above apparatus, the local transport device, when on standby, is placed in the standby position inside one of the substrate treating sections of the heat-treating unit. Consequently, the local transport device is less influenced by the environment outside the heat-treating unit than where the local transport device is kept on standby outside the heat-treating unit. The local transport device on standby influences the environment outside the heat-treating unit to a reduced degree. Variations in substrate treating precision due to such adverse influences may be reduced to perform substrate treatment with high precision. Further, temperature control of the local transport device may be effected easily. The local transport device capable of transferring the substrate between the plurality of substrate treating sections in the heat-treating unit lightens the burden on the main transport device.

Preferably, the substrate treating sections include a substrate heating section for heating the substrate, and one of a substrate cooling section for cooling the substrate and a substrate standby section for keeping the substrate on standby, the standby position being set inside one of the substrate cooling section and the substrate standby section. Thus, the local transport device, when on standby, is placed in the standby position inside the substrate cooling section or substrate standby section. The local transport device on standby is less influenced by the environment outside the heat-treating unit, and influences the environment outside the heat-treating unit to a reduced degree. Variations in substrate treating precision due to such adverse influences may be reduced to perform substrate treatment with high precision. Where the standby position is set inside the substrate cooling section, the local transport device on standby may be cooled.

Preferably, the local transport device includes a substrate cooling device for cooling the substrate held by the local transport device. This local transport device not only transports the substrate, but can start cooling the substrate the moment it holds the substrate.

Preferably, at least one of the substrate treating sections has, formed separately from each other, a local transport opening for access by the local transport device, and a main transport opening for access by the main transport device. This construction reduces the chance of interference between the local transport device and main transport device.

Preferably, one of the substrate cooling section and the substrate standby section includes a cooling device for cooling the local transport device on standby. The cooling device may cool the local transport device on standby inside the substrate cooling section or substrate standby section.

Preferably, the substrate treating sections include at least two substrate heating sections for heating the substrate, one of the substrate heating sections providing the standby position for the local transport device. With this construction, the local transport device on standby is placed in the standby position inside one of the substrate heating sections. Thus, the local transport device on standby is less influenced by the environment outside the heat-treating unit, and influences the environment outside the heat-treating unit to a reduced degree. Further, the local transport device on standby may be heated.

Alternatively, the substrate treating sections may include at least two substrate cooling sections for cooling the substrate, one of the substrate cooling sections providing the standby position for the local transport device. With this construction, the local transport device on standby is placed in the standby position inside one of the substrate cooling sections. Thus, the local transport device on standby is less influenced by the environment outside the heat-treating unit, and influences the environment outside the heat-treating unit to a reduced degree. Further, the local transport device on standby may be cooled.

This specification discloses also the following substrate treating method, substrate heat-treating apparatus and substrate transporting methods for a substrate treating apparatus:

(1) A substrate treating method for performing a series of treatments on a substrate, comprising:

a main transport step for transporting the substrate with a main transport device between a heat-treating unit for heat-treating the substrate and a different unit;

a local transport step for transporting the substrate with a local transport device between a plurality of substrate treating sections arranged vertically in the heat-treating unit; and a standby step for placing the local transport device having transported the substrate to a predetermined one of the substrate treating sections in the heat-treating unit, in a standby position set inside a different one of the substrate treating sections.

According to the substrate treating method (1) above, the standby step is executed to place the local transport device having transported the substrate to a substrate treating section, in a standby position set inside a different substrate treating section. Consequently, the local transport device is less influenced by the environment outside the heat-treating unit than where the local transport device is kept on standby outside the heat-treating unit. The local transport device on standby influences the environment outside the heat-treating unit to a reduced degree. Variations in substrate treating precision due to such adverse influences may be reduced to perform substrate treatment with high precision. Further, temperature control of the local transport device may be effected easily. The local transport device capable of transferring the substrate between the plurality of substrate treating sections in the heat-treating unit lightens the burden on the main transport device.

(2) A substrate treating apparatus for performing a series of treatments on a substrate, comprising:

a plurality of substrate treating sections arranged vertically for performing predetermined treatments on the substrate; and a local transport device provided separately from a main transport device that transfers the substrate between the substrate treating apparatus and a different apparatus, the local transport device transferring the substrate between the substrate treating sections;

one of the substrate treating sections providing a standby position for the local transport device.

According to the substrate treating apparatus (2) above, the local transport device, when on standby, is placed in the standby position inside one of the substrate treating sections of the heat-treating unit. Consequently, the local transport device is less influenced by the environment outside the heat-treating unit than where the local transport device is kept on standby outside the heat-treating unit. The local transport device on standby influences the environment outside the heat-treating unit to a reduced degree. Variations in substrate treating precision due to such adverse influences may be reduced to perform substrate treatment with high precision. Further, temperature control of the local transport device may be effected easily. The local transport device capable of transferring the substrate between the plurality of substrate treating sections in the heat-treating unit lightens the burden on the main transport device.

(3) A substrate transport method for a substrate treating apparatus for performing a series of treatments on a substrate, comprising:

a first main transport step for transporting the substrate with a first main transport device between a substrate treating section for cooling or standby in a heat-treating unit for heat-treating the substrate, and a different unit;

a second main transport step for transporting the substrate with a second main transport device between a substrate heat-treating section different from the substrate treating section for cooling or standby in the heat-treating unit, and another different unit;

a local transport step for transporting the substrate with a single local transport device separate from the first and second main transport devices, between the substrate treating section for cooling or standby and the substrate heat-treating section arranged vertically in the heat-treating unit; and a standby step for placing the local transport device having transported the substrate to one of the substrate treating section for cooling or standby and the substrate heat-treating section in the heat-treating unit, in a standby position set inside the other of the substrate treating section for cooling or standby and the substrate heat-treating section.

According to the substrate transport method (3) above, the standby step is executed to place the local transport device having transported the substrate to one substrate treating section, in a standby position set inside a different substrate treating section. Consequently, the local transport device is less influenced by the environment outside the heat-treating unit than where the local transport device is kept on standby outside the heat-treating unit. The local transport device on standby influences the environment outside the heat-treating unit to a reduced degree. Variations in substrate treating precision due to such adverse influences may be reduced to perform substrate treatment with high precision. Further, temperature control of the local transport device may be effected easily. The first main transport device accesses only the substrate treating section for cooling or standby, while the second main transport device accesses only the substrate heat-treating section. Thus, a thermal separation is provided between the first main transport device and second main transport device.

(4) A substrate transport method in a substrate treating apparatus for performing a series of treatments on a substrate, comprising:

a main transport step for transporting the substrate with a single main transport device between a particular one of a plurality of substrate treating sections arranged vertically in a heat-treating unit for heat-treating the substrate, and a different unit;

a local transport step for transporting the substrate with a single local transport device separate from the main transport device, between the substrate treating sections in the heat-treating unit; and a standby step for placing the local transport device having transported the substrate from the particular one of the substrate treating sections to a different one of the substrate treating sections, in a standby position set inside the particular one of the substrate treating sections.

According to the substrate transport method (4) above, the standby step is executed to place the local transport device having transported the substrate to a substrate treating section other than a particular substrate treating section, in a standby position set inside the particular substrate treating section. Consequently, the local transport device is less influenced by the environment outside the heat-treating unit than where the local transport device is kept on standby outside the heat-treating unit. The local transport device on standby influences the environment outside the heat-treating unit to a reduced degree. Variations in substrate treating precision due to such adverse influences may be reduced to perform substrate treatment with high precision. Further, temperature control of the local transport device may be effected easily.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

Preferred embodiments of this invention will be described in detail hereinafter with reference to the drawings.

<First Embodiment>

Figure 2:
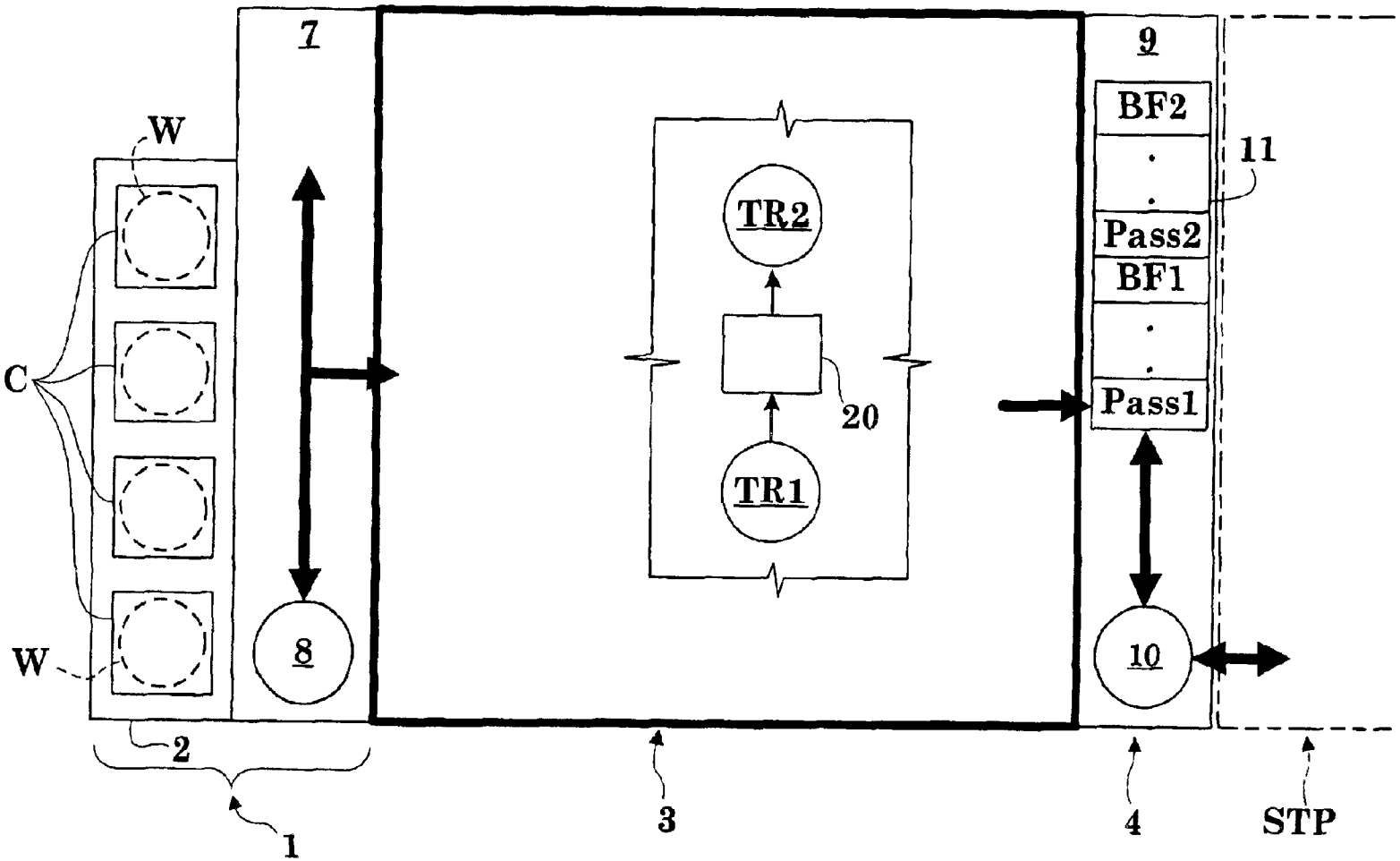
FIG. 2 is a plan view showing an outline of a substrate treating apparatus in a first embodiment of this invention.

A substrate treating apparatus in a first embodiment of this invention will be described. FIG. 2 is a plan view showing an outline of the substrate treating apparatus in the first embodiment.

The substrate treating apparatus in the first embodiment, as described hereinafter, performs a series of substrate treatments, and has, for example, a spin coater for performing resist application while spinning substrates in a photolithographic process, and a spin developer for performing development while spinning the substrates having undergone the resist application and an exposing process.

As shown in FIG. 2, the substrate treating apparatus in the first embodiment includes an indexer 1, a treating block 3 and an interface 4. The interface 4 is arranged to connect the substrate treating apparatus in the first embodiment and a different apparatus. In the first embodiment, the interface 4 connects the substrate treating apparatus for performing the resist application and development, and an exposing apparatus (e.g. a stepper for performing step-and-repeat exposure) STP, shown in a two-dot chain line in FIG. 2, for exposing the substrates.

As shown in FIG. 2, the indexer 1 includes a cassette table 2, a transport path 7 and a transport mechanism 8. The cassette table 2 is constructed for receiving thereon a plurality of (four in FIG. 2) cassettes C each containing a plurality of (e.g. 25) wafers W to be treated or wafers W already treated. The transport path 7 extends horizontally along the cassette table 2 having the plurality of cassettes C placed thereon. The transport mechanism 8 has a horizontal moving mechanism, a vertical moving mechanism and a rotating mechanism not shown. In the transport path 7, the transport mechanism 8 is movable horizontally and vertically for transferring the wafers W between the cassettes C on the cassette table 2 and the treating block 3.

A specific construction of the treating block 3 will be described next. The treating block 3 includes a plurality of treating units, and a main transport mechanism for transporting wafers W between these treating units.

The above treating units, as described hereinafter, include a BARC unit, a post-BARC heat-treating unit, an SC unit, a post-SC heat-treating unit, and an EE unit, which perform treatment before the transfer to the exposing apparatus STP, and a PEB unit which is a post-EE heat-treating unit, an SD unit, and a post-EE heat-treating unit, for performing post-exposure treatment of the wafers received from the exposing apparatus STP.

For example, the BARC unit is operable to form a bottom anti-reflection coating (hereinafter referred to as "BARC") on the wafer W for preventing reflection of light from photoresist film formed on the wafer W. Before the BARC treatment in the BARC unit, an adhesion treatment (hereinafter referred to as "AHL") is carried out for improving cohesion between the wafer W and photoresist film.

The post-BARC heat-treating unit is operable to heat and bake the wafer W after the BARC treatment in the BARC unit. The SC unit has a spin coater (hereinafter referred to as "SC") for forming photoresist film on the wafer W while spinning the wafer W. The post-SC heat-treating unit is operable to heat and bake the wafer W after the photoresist film is formed thereon in the SC unit. The EE unit is operable to expose edges of the wafer W, i.e. edge exposure (hereinafter referred to as "EE").

The PEB unit is for heating the wafer W after exposure, i.e. post-exposure bake (hereinafter referred to as "PEB"). The SD unit has a spin developer (hereinafter referred to as "SD") for developing the exposed wafer W while spinning the wafer W. The post-SD heat-treating unit is operable to heat and bake the wafer W after the development in the SD unit.

In the first embodiment, as shown in FIG. 2, the main transport mechanism is a dual mechanism including a first main transport mechanism TR1 and a second main transport mechanism TR2. FIG. 2 illustrates, in a portion of treating block 3, how the first main transport mechanism TR1 transports a wafer W from one different unit to a certain heat-treating unit 20 among the heat-treating units noted above, and the second main transport mechanism TR2 transports the wafer W heat-treated in this heat-treating unit 20 to another unit. The first and second main transport mechanisms TR1 and TR2 correspond to the main transport device of this invention.

Figure 3A:
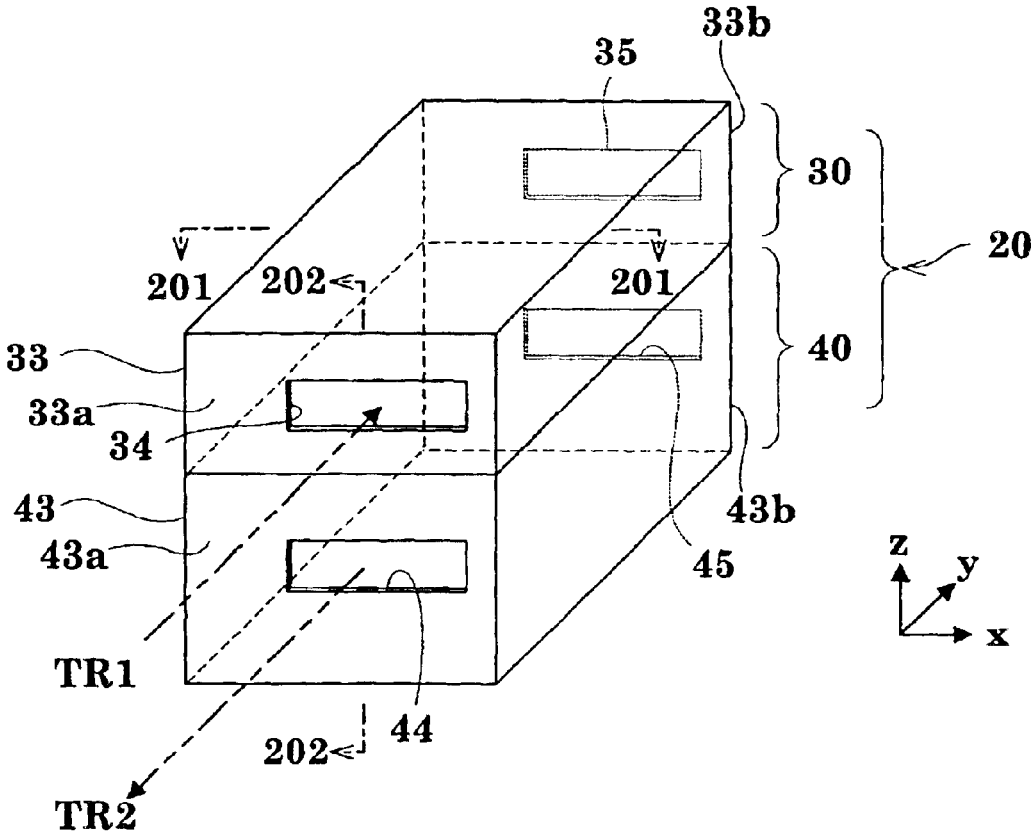
FIG. 3A is a schematic perspective view showing an outward appearance of a heat-treating unit.
Figure 3B:
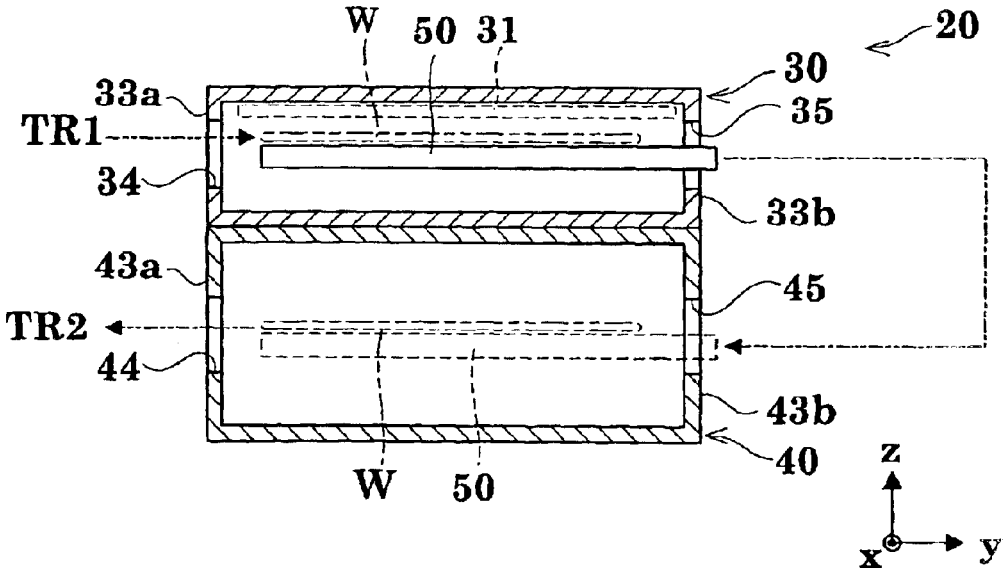
FIG. 3B is an explanatory view showing a substrate transport path in the heat-treating unit.
Figure 4:
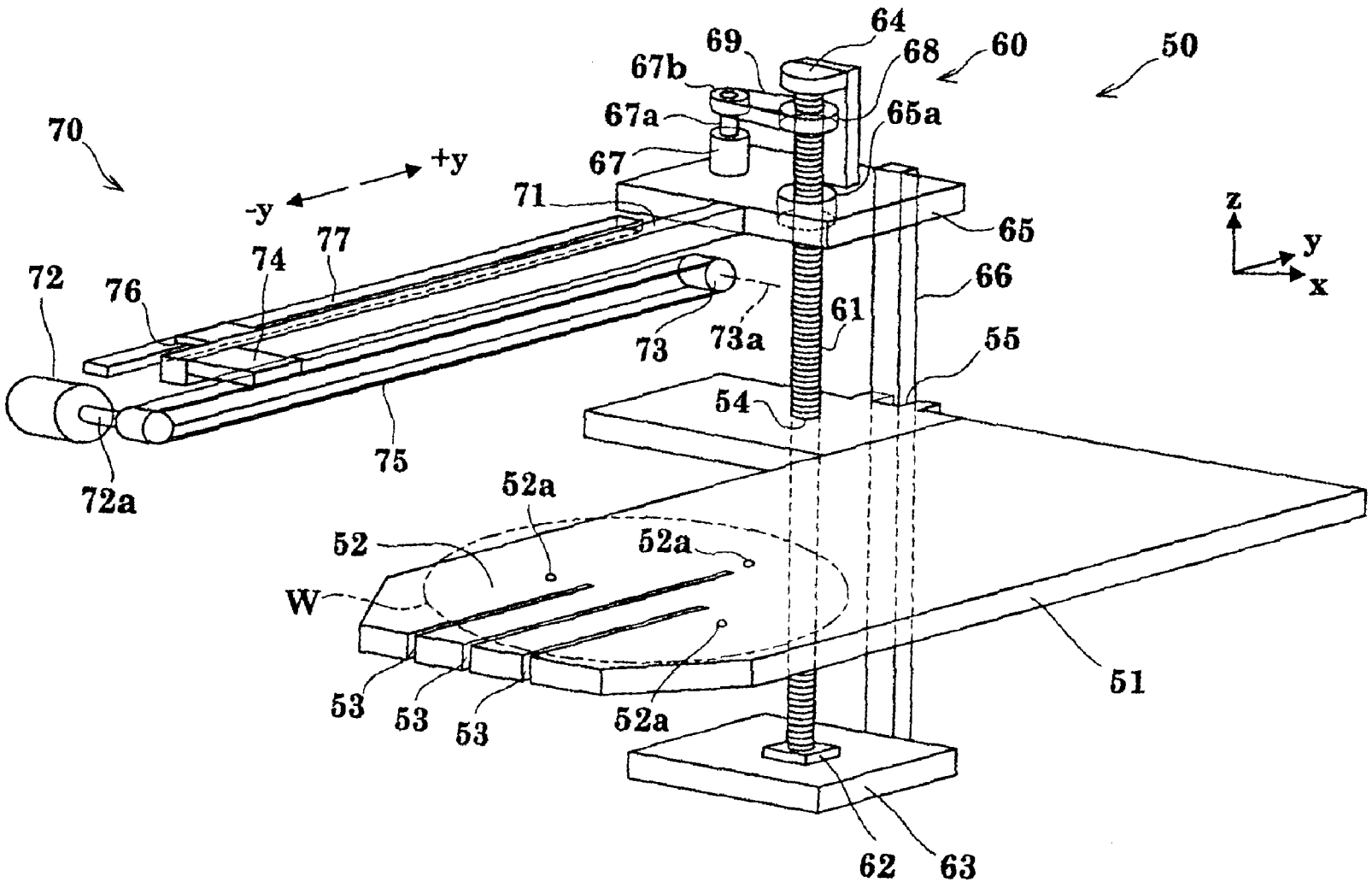
FIG. 4 is a schematic perspective view showing an outward appearance of a local transport mechanism.
Figure 5:
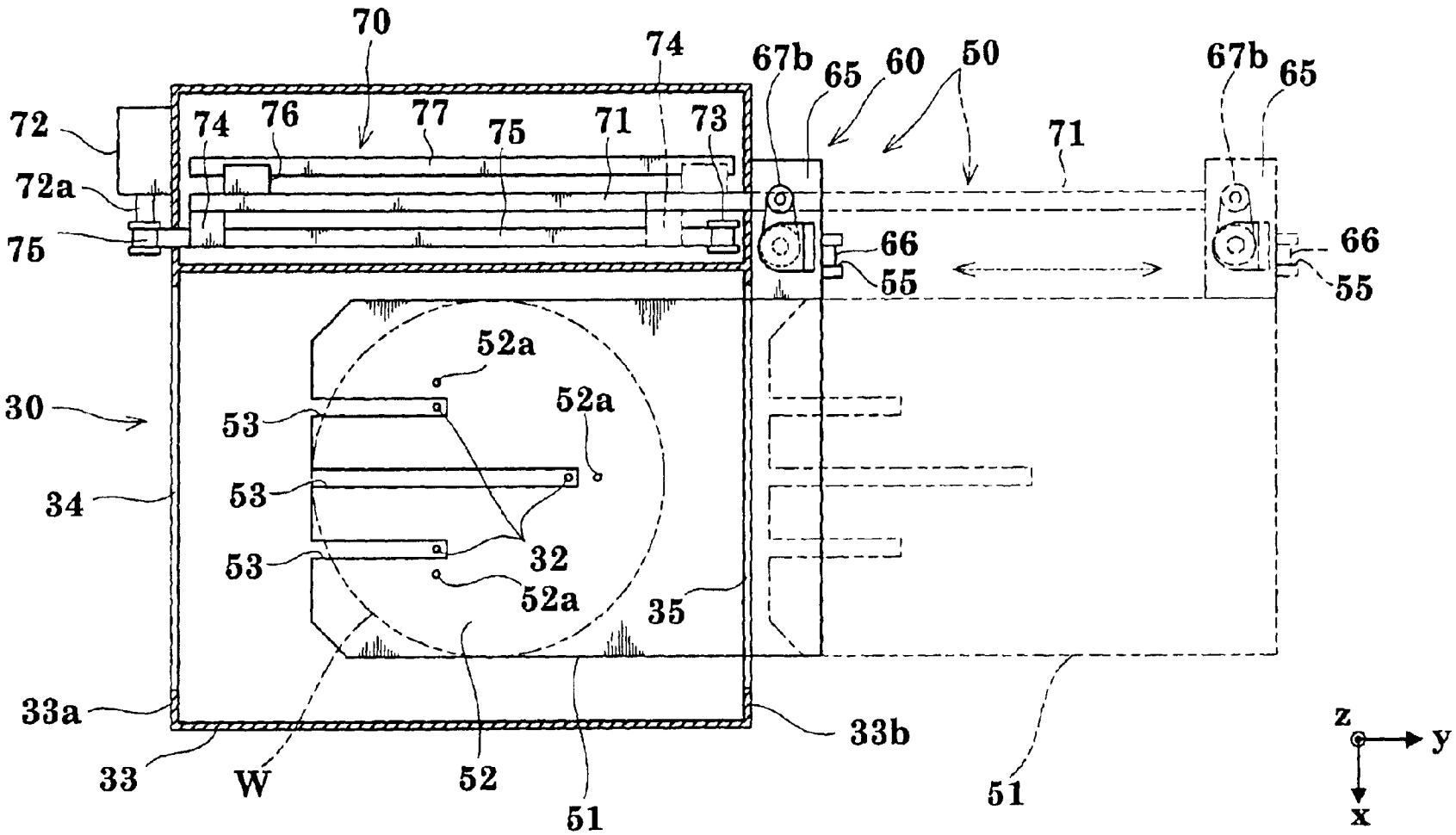
FIG. 5 is a sectional view of the heat-treating unit taken on line 201—201 of FIG. 3A.
Figure 6:
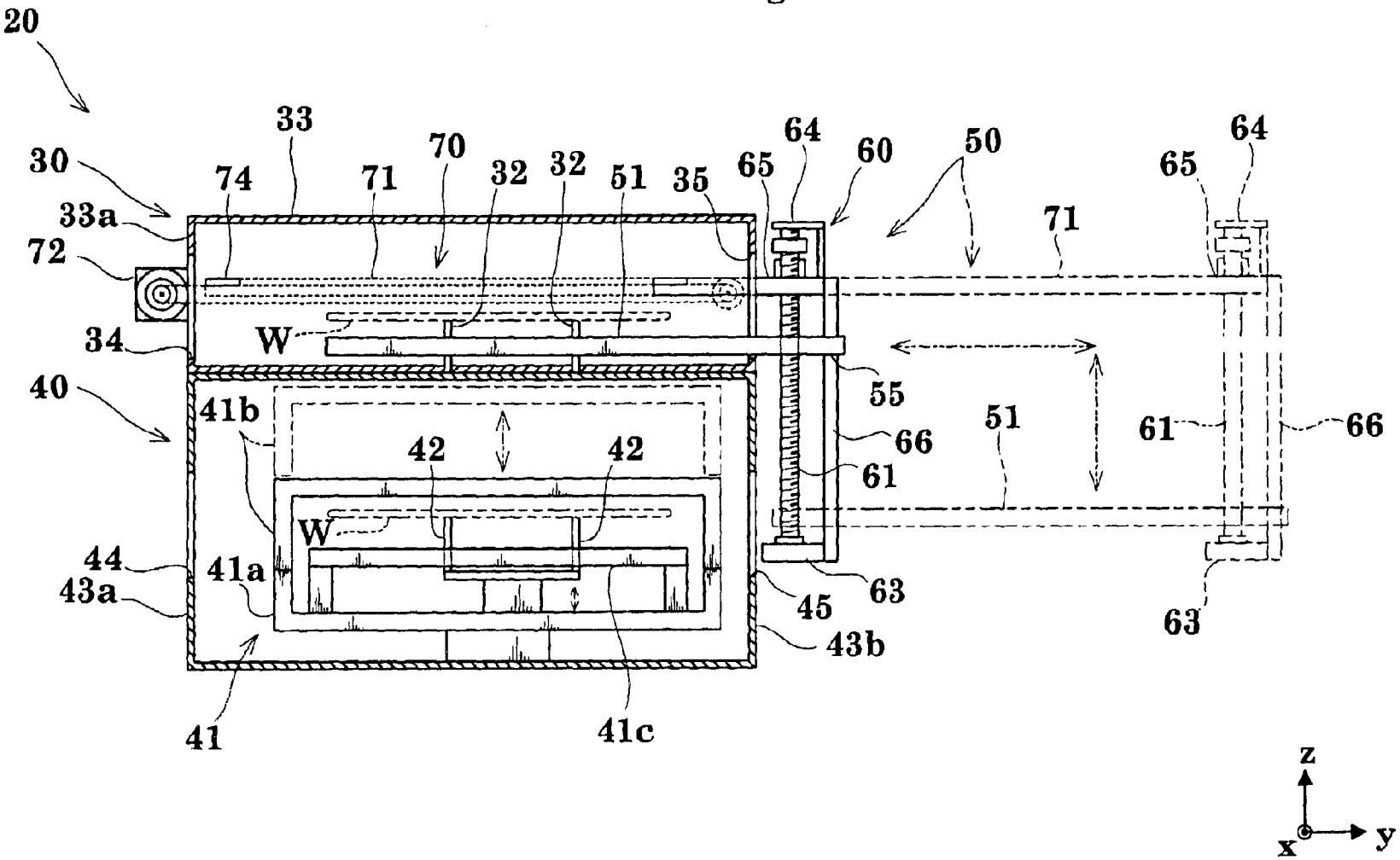
FIG. 6 is a sectional view of the heat-treating unit taken on line 202—202 of FIG. 3A.

The construction of the heat-treating unit 20 will be described with reference to FIGS. 3 through 6. FIG. 3A is a schematic perspective view showing an outward appearance of the heat-treating unit 20. FIG. 3B is an explanatory view showing a transport path of wafer W in the heat-treating unit 20. FIG. 4 is a schematic perspective view showing an outward appearance of a local transport mechanism 50. FIG. 5 is a sectional view of the heat-treating unit 20 taken on line 201—201 of FIG. 3A. FIG. 6 is a sectional view of the heat-treating unit 20 taken on line 202—202 of FIG. 3A.

As shown in FIGS. 3A and 3B, the heat-treating unit 20 includes a cooling unit 30 for cooling the wafer W, a heating unit 40 disposed under the cooling unit 30 for heating the wafer W, and a local transport mechanism 50 provided separately from the first and second main transport mechanisms TR1 and TR2 for transferring the wafer W between the cooling unit 30 and heating unit 40. The cooling unit 30, heating unit 40 and local transport mechanism 50 will be described hereinafter in the state order.

As shown in FIG. 3B, the cooling unit 30 includes a cooler 31 for forcibly cooling its interior space for accommodating the wafer W. The cooler 31 may effect the forcible cooling by using, for example, a cooling gas, cooling water or thermo-electric cooling elements (e.g. Peltier elements).

As shown in FIGS. 5 and 6, the cooling unit 30 has a plurality of (e.g. three) support pins 32 arranged in predetermined positions spaced from one another therein. The wafer W has an undersurface thereof contacting upper ends of the three support pins 32 to be held in horizontal posture for cooling treatment. The cooling unit 30 has a housing 33 with an access opening 34 formed in a front wall 33*a* thereof for the first main transport mechanism TR1 to load the wafer W transported from a different treating unit into the cooling unit 30. The housing 33 of the cooling unit 30 has an access opening 35 formed in a rear wall 33*b* thereof for the local transport mechanism 50 to unload the wafer W from the cooling unit 30. The main transport mechanism access opening 34 and local transport mechanism access opening 35 have shutter mechanisms (not shown), for example. Each shutter mechanism opens the access opening 34 or 35 in time of access by the first main transport mechanism TR1 or local transport mechanism 50, and keeps the access opening 34 or 35 closed at other times.

The above access opening 34 corresponds to the main transport mechanism access opening of this invention. The access opening 35 corresponds to the local transport mechanism access opening of this invention.

The heating unit 40 will be described next. As shown in FIG. 6, the heating unit 40 includes a heating furnace (chamber) 41 for heating the wafer W. The heating furnace 41 has a container body 41*a* for receiving the wafer W, an openable top cover 41*b* for closing an opening of the container body 41*a,* and a hot plate 41*c* for heating the wafer W placed on an upper surface thereof. The heating furnace 41 has a plurality of (e.g. three) support pins 42 arranged in predetermined positions spaced from one another therein. The wafer W has the undersurface thereof contacting upper ends of the three support pins 42 to be held in horizontal posture. A lift mechanism not shown is operable to lower the support pins 42, whereby the wafer W is laid on the upper surface of hot plate 41*c* for heating treatment. The heating unit 40 has a housing 43 with an access opening 45 formed in a rear wall 43*b* thereof for the local transport mechanism 50 to load the wafer W transported from the cooling unit 30 into the heating unit 40. The housing 43 of the heating unit 40 has an access opening 44 formed in a front wall 43*a* thereof for the second main transport mechanism TR2 to unload the wafer W from the heating unit 40. The main transport mechanism access opening 44 and local transport mechanism access opening 45 have shutter mechanisms (not shown), for example. Each shutter mechanism opens the access opening 44 or 45 in time of access by the second main transport mechanism TR2 or local transport mechanism 50, and keeps the access opening 44 or 45 closed at other times.

The above access opening 44 corresponds to the main transport mechanism access opening of this invention. The access opening 45 corresponds to the local transport mechanism access opening of this invention.

The construction of the local transport mechanism 50 will be described hereinafter. As shown in FIGS. 4 through 6, the local transport mechanism 50 includes a plate 51 for holding the wafer W in horizontal posture, a vertical moving mechanism 60 for vertically moving the plate 51, and a horizontal moving mechanism 70 for horizontally moving the plate 51.

As shown in FIGS. 4 and 5, the plate 51 has a substrate holding portion 52 adjacent a forward end thereof for holding the wafer W in horizontal posture. The substrate holding portion 52 has a plurality of small projections (e.g. hemispherical projections) 52*a* slightly projecting in z-direction from an upper surface thereof for holding the wafer W. Thus, only the small projections 52*a* contact the undersurface of wafer W to support the wafer W through point contact, leaving a slight gap between the undersurface of wafer W and the upper surface of plate 51. The substrate holding portion 52 has a plurality of (e.g. three) cutouts 53 formed therein to extend in y-direction. When the substrate holding portion 52 is moved into the cooling unit 30 or heating unit 40, the cutouts 53 receive the three support pins 32 for supporting the wafer W in the cooling unit 30 or the three support pins 42 for supporting the wafer W in the heating unit 40, in order that the substrate holding portion 52 does not collide with the support pins 32 or 42.

As shown in FIG. 4, the vertical moving mechanism 60 includes a rotary screw 61 extending vertically (in z-direction) and meshed with a threaded bore 54 formed in a proximal portion of the plate 51, a lower support plate 63 having a bearing 62 for rotatably supporting the lower end of rotary screw 61, an upper support plate 65 having a bore 65*a* for receiving the rotary screw 61 in a non-contact manner and a bearing 64 for rotatably supporting the upper end of rotary screw 61, a guide rail 66 extending vertically (in z-direction) and contacting a guide groove 55 formed in the proximal portion of plate 51, a motor 67 mounted on the upper support plate 65 to have a rotary shaft 67*a* extending vertically (in z-direction), and a timing belt 69 for connecting a rotary element 67*b* attached to a distal end of the rotary shaft 67*a* of motor 67 to an element 68 fixed to the rotary screw 61. Thus, when the motor 67 rotates in a predetermined direction (e.g. "forward rotation"), the rotation (forward rotation) of the motor 67 is transmitted to the rotary screw 61 through the timing belt 69, to rotate the rotary screw 61 forward. Then, the plate 51 is raised along the guide rail 66. When the motor 67 rotates in a direction reversed from the above (e.g. "backward rotation"), the rotation (backward rotation) of the motor 67 is transmitted to the rotary screw 61 through the timing belt 69, to rotate the rotary screw 61 backward. Then, the plate 51 is lowered along the guide rail 66.

As shown in FIG. 4, the horizontal moving mechanism 70 includes a bar 71 extending from the upper support plate 65 in a direction (y-direction) for moving the plate 51 back and forth, a motor 72 disposed inside the housing 33 of cooling unit 30 to have a rotary shaft 72*a* thereof extending in x-direction, a rotatable member 73 disposed inside the housing 33 of cooling unit 30 and spaced in y-direction from the motor 72 to have a rotary shaft 73*a* thereof extending in x-direction, a timing belt 75 connecting the rotary shaft 72*a* of motor 72 and the rotatable member 73 and fixed in a predetermined position thereof to a fixed element 74 provided at a distal end of the bar 71, and a guide rail 77 extending in the direction of movement (y-direction) and contacting a guide groove 76 formed in the distal end of bar 71. Thus, when the motor 72 rotates in a predetermined direction (e.g. "forward rotation"), the timing belt 75 is driven to move the fixed element 74 away from the motor 72. Then, the plate 51 and vertical moving mechanism 60 advance along the guide rail 77 (in the direction of +y). When the motor 72 rotates in a direction reversed from the above (e.g. "backward rotation"), the timing belt 75 is driven to move the fixed element 74 toward the motor 72. Then, the plate 51 and vertical moving mechanism 60 retreat along the guide rail 77 (in the direction of −y).

As shown in FIG. 6, the plate 51 of the local transport mechanism 50, when on standby, is contained in a standby position inside the cooling unit 30. The plate 51 of the local transport mechanism 50 in the standby position lies adjacent a bottom surface inside the cooling unit 30. That is, the plate 51 is placed at a predetermined distance below the upper ends of support pins 32. When the first main transport mechanism TR1 loads the wafer W on the support pins 32 in the cooling unit 30, the plate 51 of the local transport mechanism 50 in the standby position remains out of contact or otherwise presents no obstruction.

The construction of the interface 4 will be described next. As shown in FIG. 2, the interface 4 includes a transport path 9, a transport mechanism 10 and a table 11. The transport path 9 is formed parallel to the transport path 7 of indexer 1. The transport mechanism 10 has a horizontal moving mechanism, a vertical moving mechanism and a rotating mechanism not shown. Thus, the transport mechanism 10 is horizontally and vertically movable in the transport path 9 to transport wafers W between the tables 11 and the exposing apparatus (stepper) STP shown in two-dot chain lines in FIG. 2. The exposing apparatus STP is provided separately from and connectable to the apparatus in the first embodiment. Where the wafers W are not transferred between the apparatus in the first embodiment and the exposing apparatus STP, the exposing apparatus STP may be separated from the interface 4 of the apparatus in the first embodiment.

As shown in FIG. 2, the table 11 includes, arranged in vertical stages, a Pass 1 for receiving wafers W transferred between the first and second main transport mechanisms TR1 and TR2 and the transport mechanism 10 to be delivered to the exposing apparatus STP, a plurality of buffers BF1 for temporarily storing the wafers W to be delivered to the exposing apparatus STP, a Pass 2 for receiving wafers W from the exposing apparatus STP and transferred between the first and second main transport mechanisms TR1 and TR2 and the transport mechanism 10, and a plurality of buffers BF2 for temporarily storing the wafers W returned from the exposing apparatus STP.

The local transport mechanism 50 noted above corresponds to the local transport device of this invention. The cooling unit 30 and heating unit 40 constitute the substrate treating sections of this invention. The cooling unit 30 corresponds to the substrate cooling section of this invention. The heating unit 40 corresponds to the substrate heating section of this invention.

Heat treatment in a series of substrate treatments in a photolithographic process by the substrate treating apparatus in the first embodiment, i.e. a heat-treating operation of the heat-treating unit 20 in the treating block 3, will be described hereinafter with reference to FIGS. 7 through 9. FIGS. 7A through 7C, 8A through 8C, and 9A and 9B are views illustrating operation of the local transport mechanism 50 of the heat-treating unit 20.

Figure 7A:
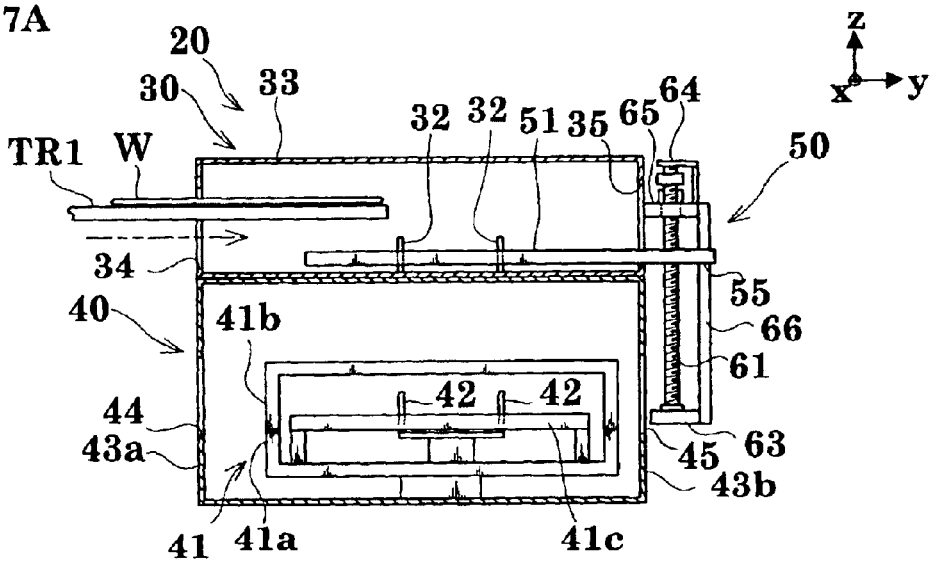
FIGS. 7A through 7C are views illustrating operation of the local transport mechanism in the heat-treating unit.

(1) Loading of Wafer W into the Cooling Unit 30 by the First Main Transport Mechanism TR1:

As shown in FIG. 7A, the main transport mechanism access opening 34 of the cooling unit 30 is opened as the first main transport mechanism TR1 holding a wafer W approaches the access opening 34. The first main transport mechanism TR1 holding the wafer W enters the access opening 34 of the cooling unit 30, and withdraws from the cooling unit 30 after delivering the wafer W, which has been transported from a different treating unit, to a delivery position (e.g. on the three support pins 32) inside the cooling unit 30. At this time, the plate 51 of the local transport mechanism 50 is placed in the standby position adjacent the bottom in the cooling unit 30. When the first main transport mechanism TR1 loads the wafer W on the support pins 32 in the cooling unit 30, the first main transport mechanism TR1 never contacts the plate 51 of the local transport mechanism 50 in the standby position, or the local transport mechanism 50 never obstructs the loading operation. The main transport mechanism access opening 34 of the cooling unit 30 is closed after the first main transport mechanism TR1 withdraws therefrom. The cooling unit 30 keeps the wafer W on standby. In the cooling unit 30, the wafer W is cooled, as necessary, during the standby.

Figure 7B:
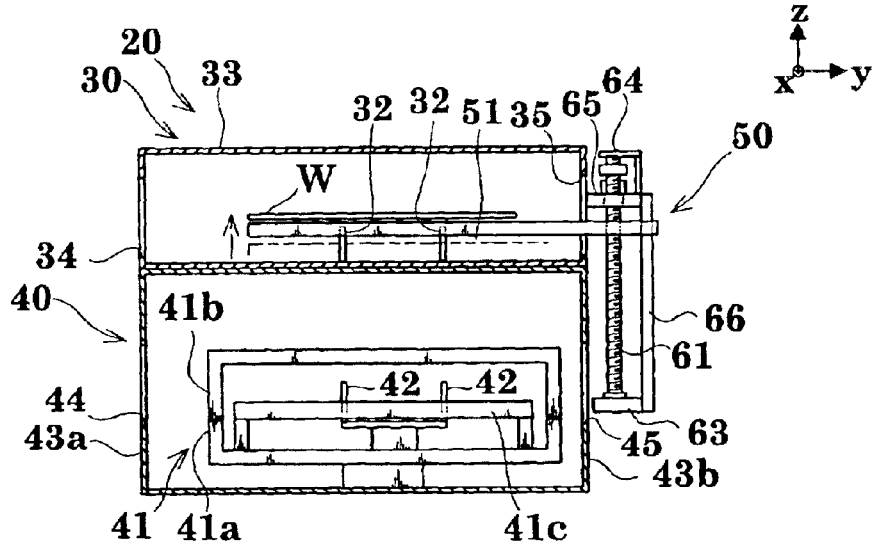
Figure 7C:
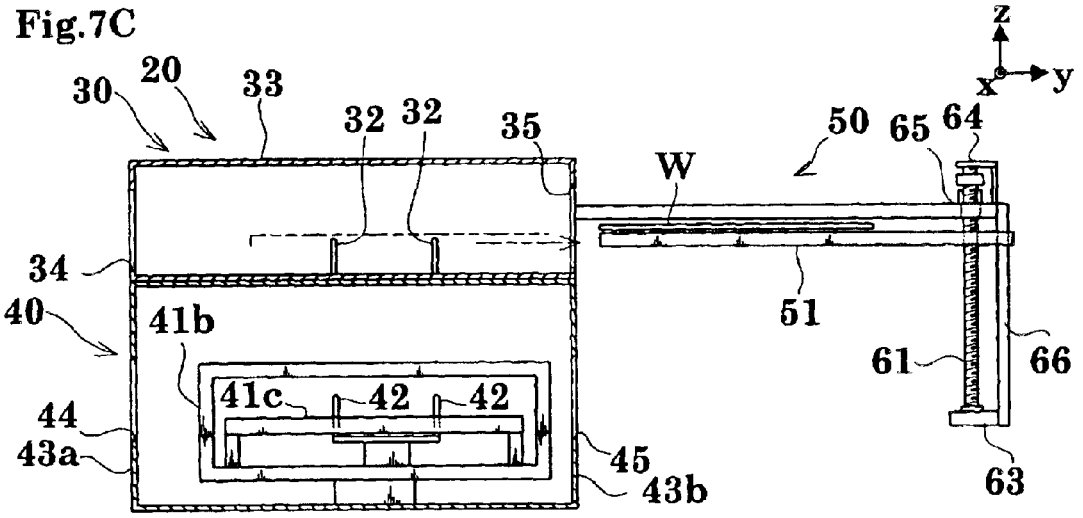

(2) Receipt of Wafer W by the Local Transport Mechanism 50:

Upon completion of the receipt or cooling of the wafer W by the cooling unit 30, as shown in FIG. 7B, the vertical moving mechanism 60 of the local transport mechanism 50 is driven to raise the plate 51 and pick up the wafer W supported on the three support pins 32. Then, the local transport mechanism access opening 35 of the cooling unit 30 is opened. As shown in FIG. 7C, the horizontal moving mechanism 70 of the local transport mechanism 50 is driven to move the plate 51 in y-direction out of the cooling unit 30. After the plate 51 of the local transport mechanism 50 moves outside, the access opening 35 of the cooling unit 30 is closed.

Figure 8A:
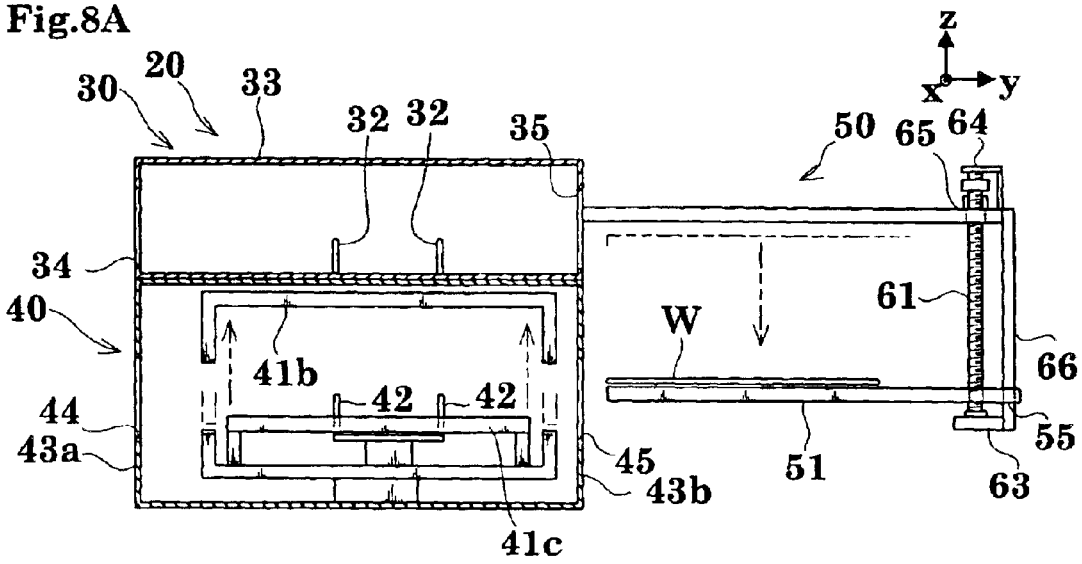
FIGS. 8A through 8C are views illustrating operation of the local transport mechanism in the heat-treating unit.
Figure 8B:
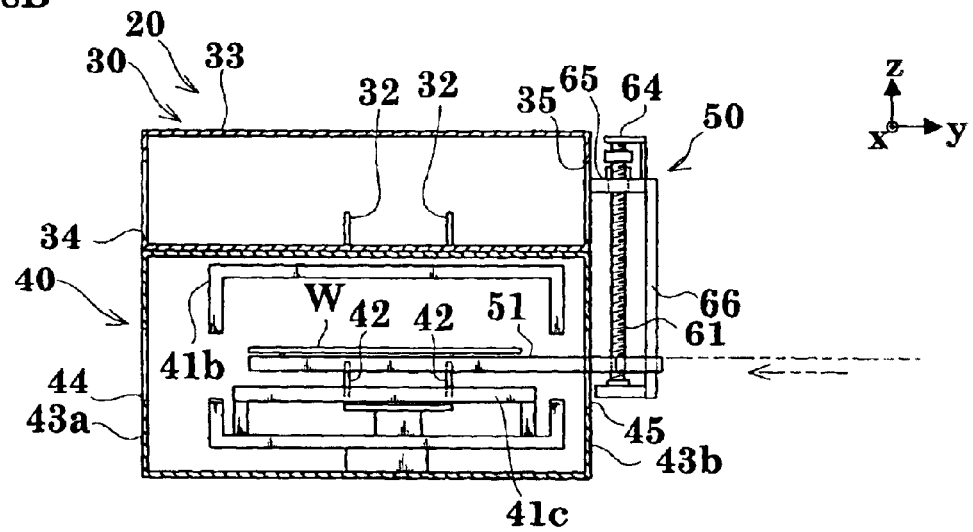
Figure 8C:
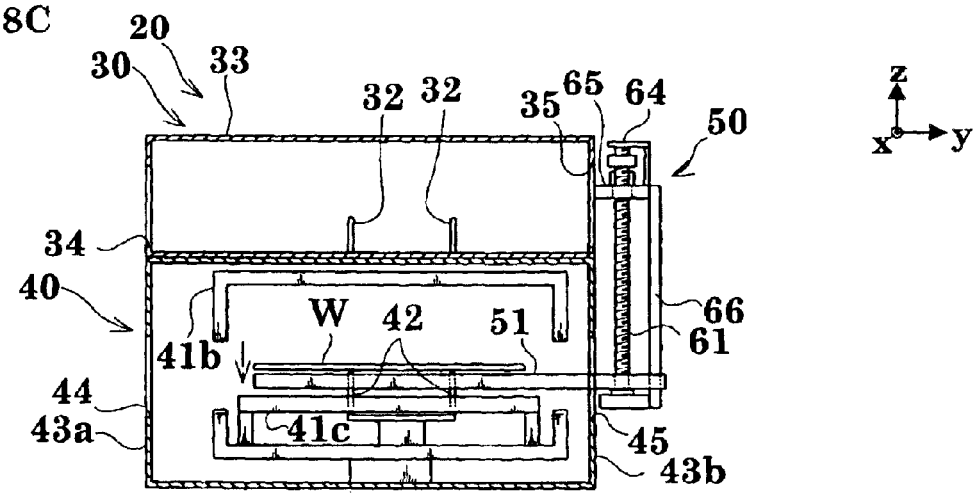

(3) Loading of Wafer W into the Heating Unit 40 by the Local Transport Mechanism 50:

As shown in FIG. 8A, the vertical moving mechanism 60 of the local transport mechanism 50 is driven to lower the plate 51 to a level for loading the wafer W into the heating unit 40. Then, the local transport mechanism access opening 45 of the heating unit 40 is opened. As shown in FIG. 8B, the horizontal moving mechanism 70 of the local transport mechanism 50 is driven to move the plate 51 in y-direction into the heating unit 40. As shown in FIG. 8C, the vertical moving mechanism 60 is driven to lower the plate 51 to a wafer delivery level to deliver the wafer W to a delivery position (e.g. on the three support pins 42) inside the heating furnace 41 of the heating unit 40. Alternatively, the pins 42 of the heating unit 40 are raised to receive the wafer W. Then, the horizontal moving mechanism 70 is driven to withdraw the plate 51 in y-direction out of the heating unit 40. The plate 51 of the local transport mechanism 50 is further moved in an operation reversed from the foregoing operation. Ultimately, the plate 51 is placed in the standby position adjacent the bottom surface inside the cooling unit 30 as shown in FIG. 7A. The local transport mechanism access opening of the heating unit 40 is closed after the plate 51 of the local transport mechanism 50 leaves the heating unit 40.

Figure 9A:
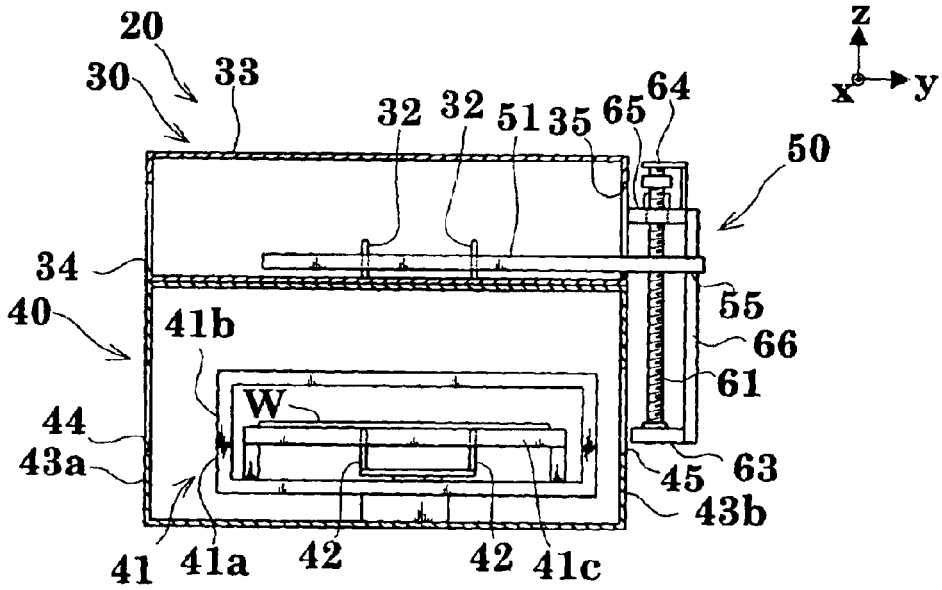
FIGS. 9A and 9B are views illustrating operation of the local transport mechanism in the heat-treating unit.
Figure 9B:
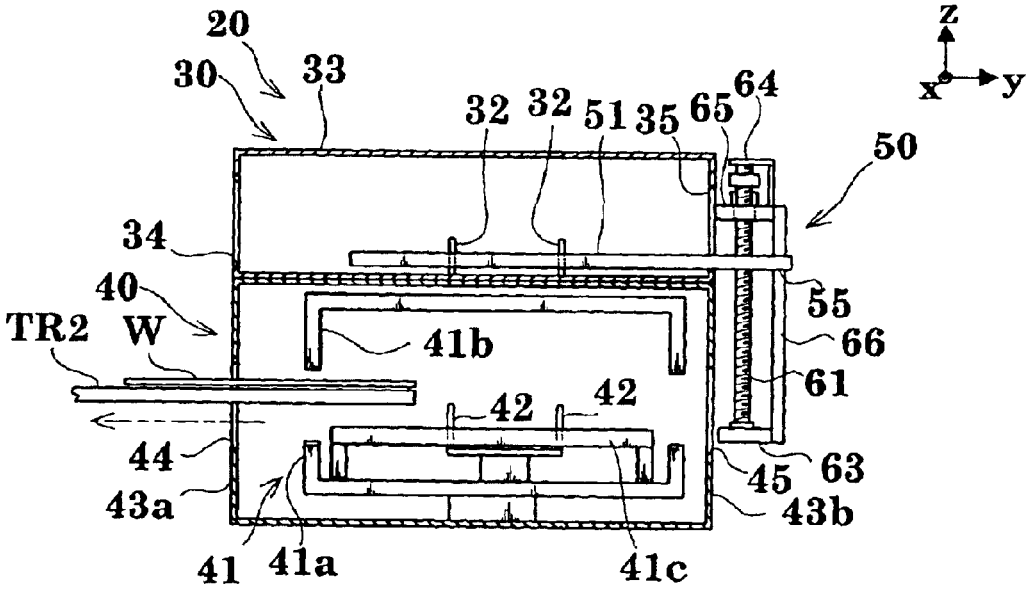

(4) Heating of Wafer W by the Heating Unit 40:

As shown in FIG. 9A, the heating furnace 41 lowers the top cover 41*b* to close the opening of the container body 41*a*, and lowers the support pins 42 to place the wafer W on the upper surface of hot plate 41*c*. In this state, the wafer W receives a predetermined heating treatment in the heating furnace 41. After the heating treatment, the heating furnace 41 raises the top cover 41*b* to open the opening of the container body 41*a*, and raises the support pins 42 to support the wafer W in a position away from the upper surface of hot plate 41*c*. As noted hereinbefore, the heating treatment may be performed to bake the wafer W after a bottom coating is formed thereon in the BARC unit, to bake the wafer W after a photoresist film is formed thereon in the SC unit, to bake the wafer W after exposure, i.e. PEB treatment, or to bake the wafer W after development.

(5) Unloading of Wafer W from the Heating Unit 40 by the Second Main Transport Mechanism TR2:

The main transport mechanism access opening 44 of the heating unit 40 is opened as the second main transport mechanism TR2 approaches the access opening 44. As shown in FIG. 9B, the second main transport mechanism TR2 enters the access opening 44 of the heating unit 40. The second main transport mechanism TR2 picks up and holds the wafer W supported by the three support pins 42 raised after the heating treatment in the heating furnace 41, then withdraws from the heating unit 40, and transports the heated wafer W to a predetermined different treating unit.

The operations of the first and second main transport mechanisms TR1 and TR2 for transporting the wafer W described in sections (1) and (5) above correspond to the main transport step. The operation of the local transport mechanism 50 for transporting the wafer W described in sections (2) and (3) above corresponds to the local transport step. The standby of the local transport mechanism 50 in the standby position inside the cooling unit 30 described in sections (1) and (3) above corresponds to the standby step. More particularly, the operation of the first main transport mechanism TR1 for transporting the wafer W to the cooling unit 30 described in section (1) above corresponds to the first main transport step. The operation of the second main transport mechanism TR2 for transporting the wafer W from the heating unit 40 described in section (5) above corresponds to the second main transport step. The operation of the local transport mechanism 50 for transporting the wafer W described in sections (2) and (3) above corresponds to the local transport step. The standby of the local transport mechanism 50 in the standby position inside the cooling unit 30 described in sections (1) and (3) above corresponds to the standby step.

According to the substrate treating apparatus in the first embodiment, as described above, the local transport mechanism 50, when on standby, is placed in the standby position inside the cooling unit 30 of the heat-treating unit 20. Consequently, the local transport mechanism 50 is less influenced by the environment outside the heat-treating unit 20 than where the local transport mechanism 50 is kept on standby outside the heat-treating unit 20. The local transport mechanism 50 on standby influences the environment outside the heat-treating unit 20 to a reduced degree. Variations in substrate treating precision due to such adverse influences may be reduced to perform substrate treatment with high precision. Further, temperature control of the local transport mechanism 50 may be effected easily. The local transport mechanism 50 capable of transferring wafers W between the cooling unit 30 and heating unit 40 in the heat-treating unit 20 lightens the burden on the first and second main transport mechanisms TR1 and TR2.

Figure 1:
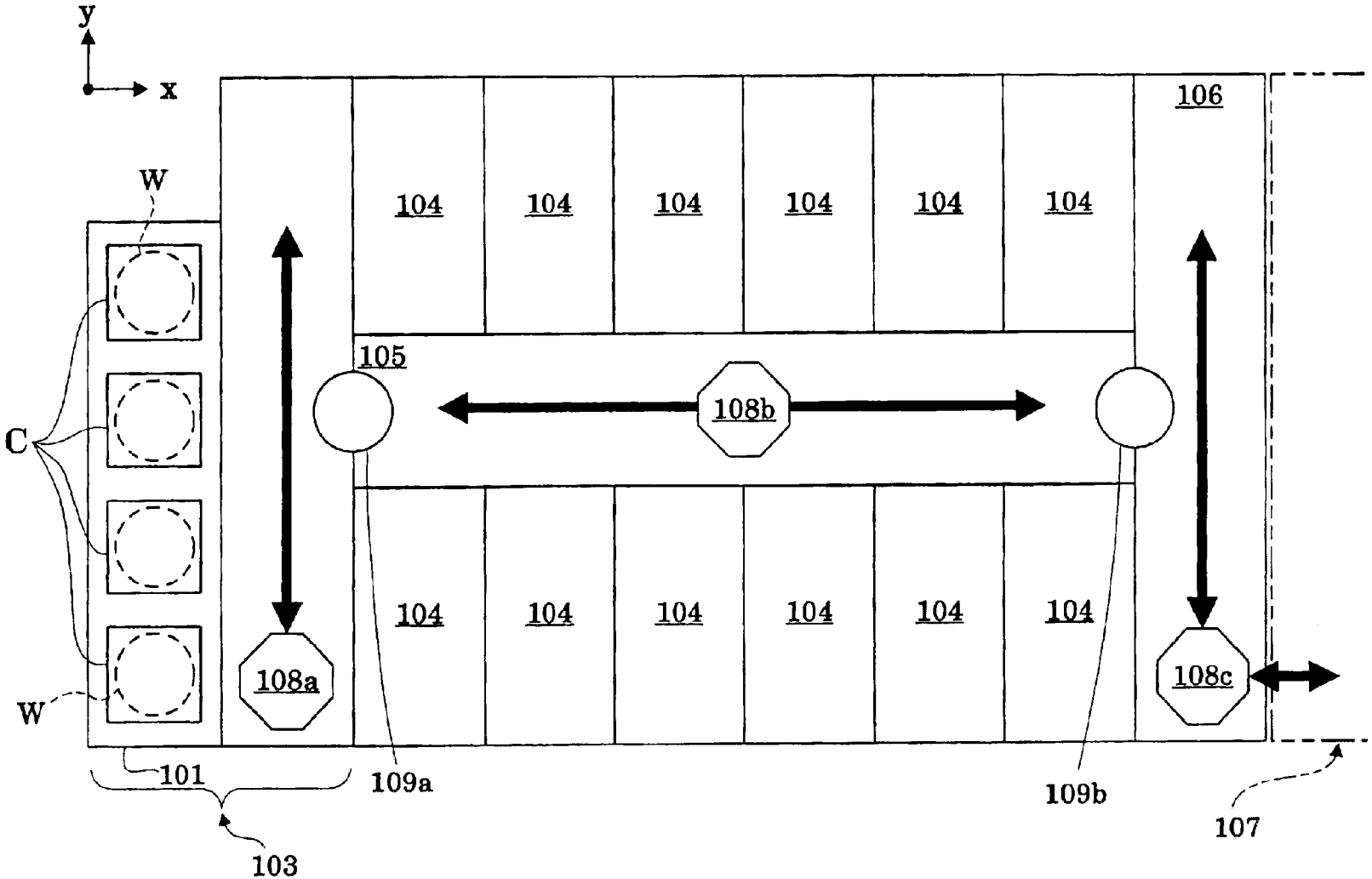
Fig.1 (PRIOR ART)
FIG. 1 is a block diagram showing the construction of a conventional substrate treating apparatus.

In the conventional substrate treating apparatus, the local transport mechanism of each heat-treating unit (heat-treating unit among the treating units 104 in FIG. 1) remains protruding from this heat-treating unit in a normal state, and temporarily enters the heat-treating unit only in time of substrate transport. The conventional substrate treating apparatus has poor maintenability since the local transport mechanism protruding from the heat-treating unit is obstructive to movement of the interface or the like. However, in the substrate treating apparatus in the first embodiment, the local transport mechanism 50 of the heat-treating unit 20 moves out of the heat-treating unit 20 only temporarily, that is only when transporting wafers W. In a normal state other than the time of transporting wafers W, the local transport mechanism 50 does not protrude from the heat-treating unit 20. Thus, the substrate treating apparatus in the first embodiment has excellent maintenability in that the interface 4 or the like may be moved without obstruction.

The cooling unit 30 and heating unit 40 have the access openings 35 and 45 for the local transport mechanism 50 separately from the access openings 34 and 44 for the first main transport mechanism TR1 and second main transport mechanism TR2. This arrangement reduces the chance of interference between the local transport mechanism 50 and the first and second main transport mechanisms TR1 and TR2.

Further, the first main transport mechanism TR1 accesses only the cooling unit 30 of the heat-treating unit 20, while the second main transport mechanism TR2 accesses only the heating unit 40 of the heat-treating unit 20. This provides a thermal separation between the first and second main transport mechanisms TR1 and TR2.

<Second Embodiment>

Figure 10:
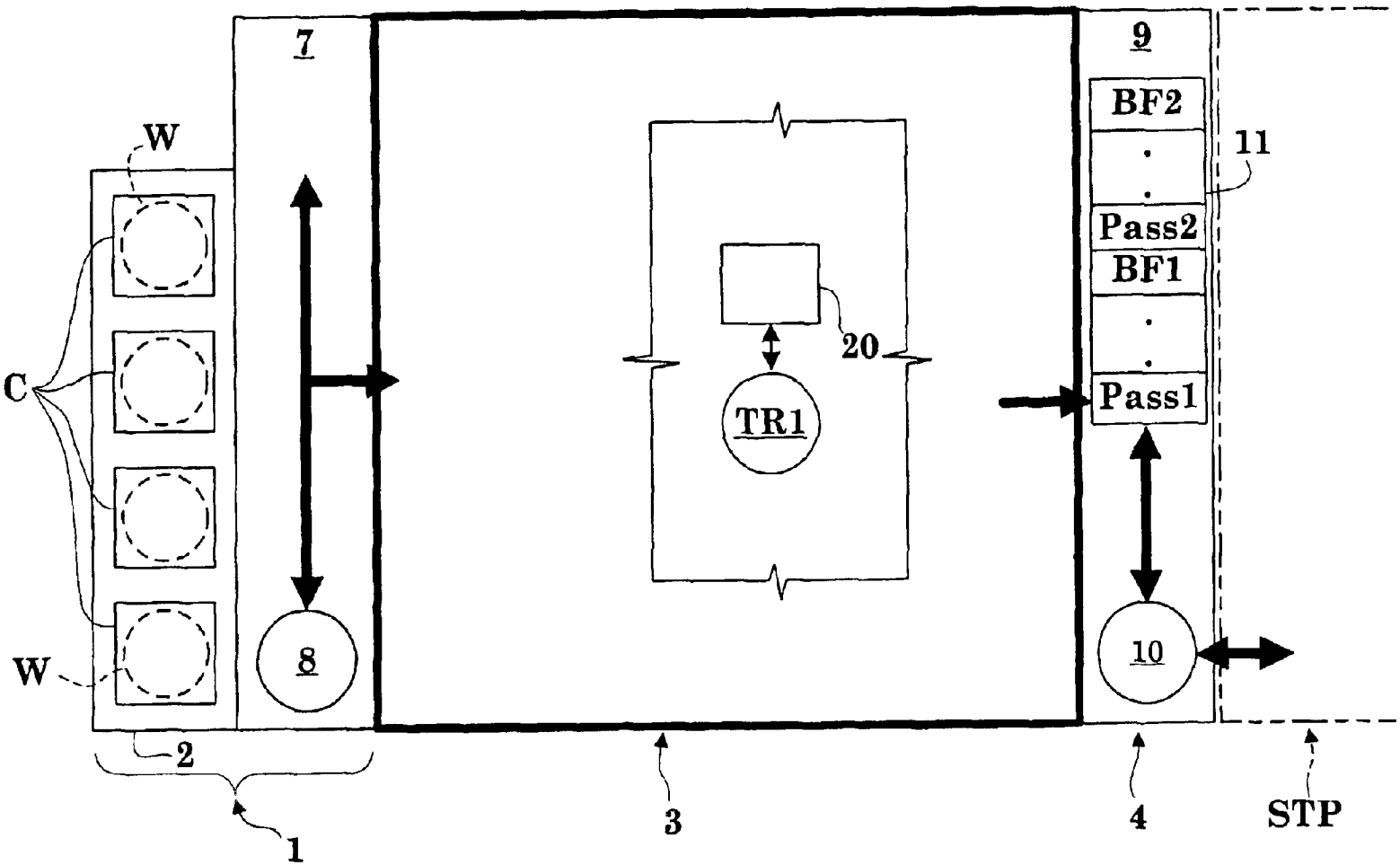
FIG. 10 is a plan view showing an outline of a substrate treating apparatus in a second embodiment of this invention.
Figure 11A:
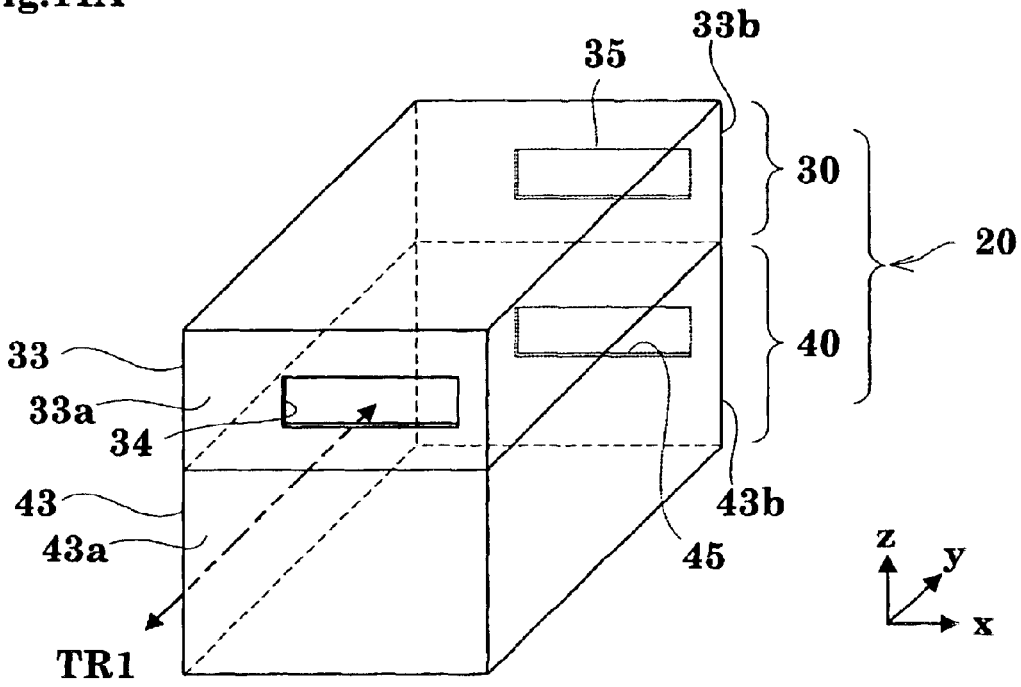
FIG. 11A is a schematic perspective view showing an outward appearance of a heat-treating unit.
Figure 11B:
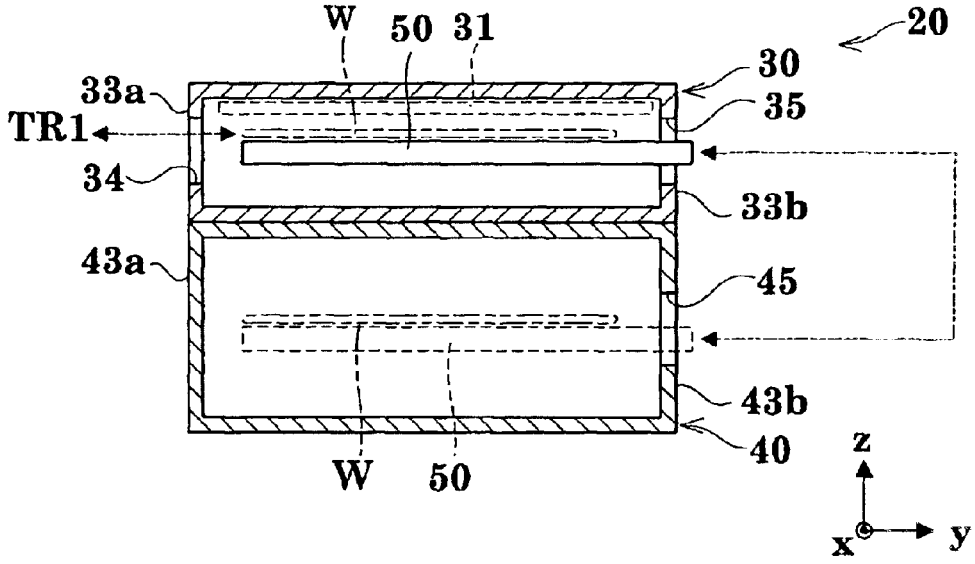
FIG. 11B is an explanatory view showing a substrate transport path in the heat-treating unit.

A second embodiment will be described with reference to FIGS. 10 and 11. FIG. 10 is a plan view showing an outline of a substrate treating apparatus in the second embodiment of this invention. FIG. 11A is a schematic perspective view showing an outward appearance of a heat-treating unit 20. FIG. 11B is an explanatory view showing a transport path of wafers W in the heat-treating unit 20.

In the first embodiment described above, as shown in FIG. 2, the treating block 3 includes the two main transport mechanisms (first and second main transport mechanisms TR1 and TR2). The first main transport mechanism TR1 accesses the cooling unit 30 of the heat-treating unit 20, while the second main transport mechanism TR2 accesses the heating unit 40 of the heat-treating unit 20. In the second embodiment, as shown in FIG. 10, the treating block 3 includes only one main transport mechanism (first main transport mechanism TR1). The first main transport mechanism TR1 accesses the cooling unit 30 of the heat-treating unit 20. Like references are used to identify like parts which are the same as in the first embodiment and will not particularly be described again.

As shown in FIG. 11, the heating unit 40 of the heat-treating unit 20 in the second embodiment has, eliminated therefrom, the main transport mechanism access opening 44 formed in the front wall of housing 43 and the shutter mechanism (not shown) for opening and closing this access opening 44 which are provided for the heating unit 40 in the first embodiment described hereinbefore.

Heat treatment in a series of substrate treatments in a photolithographic process by the substrate treating apparatus in the second embodiment, i.e. a heat-treating operation of the heat-treating unit 20 in the treating block 3, will be described hereinafter with reference to FIGS. 12 through 14. FIGS. 12A through 12C, 13A through 13C, and 14A and 14B are views illustrating operation of the local transport mechanism 50 of the heat-treating unit 20.

Figure 12A:
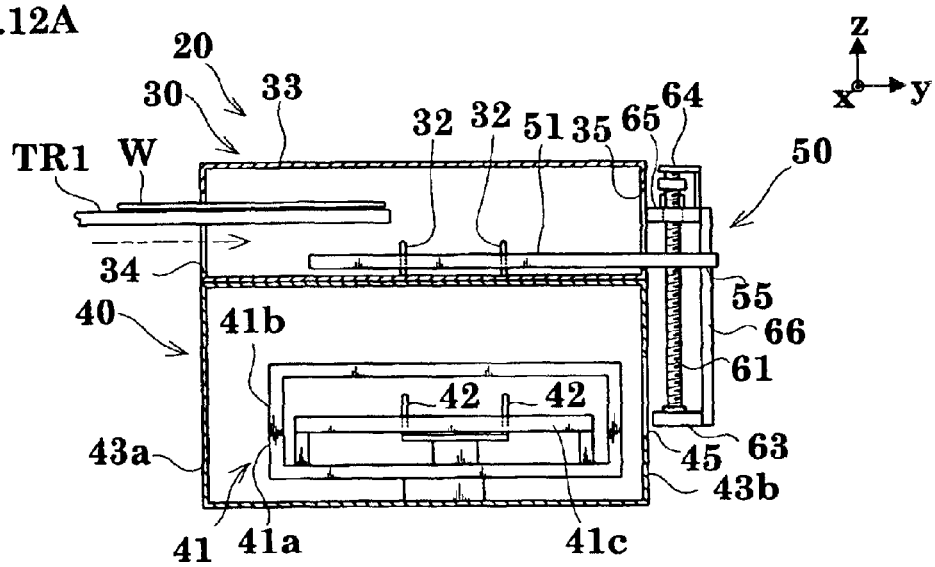
FIGS. 12A through 12C are views illustrating operation of a local transport mechanism in the heat-treating unit.

(11) Loading of Wafer W into the Cooling Unit 30 by the First Main Transport Mechanism TR1:

As shown in FIG. 12A, the main transport mechanism access opening 34 of the cooling unit 30 is opened as the first main transport mechanism TR1 holding a wafer W approaches the access opening 34. The first main transport mechanism TR1 holding the wafer W enters the access opening 34 of the cooling unit 30, and withdraws from the cooling unit 30 after delivering the wafer W, which has been transported from a different treating unit, to a delivery position (e.g. on the three support pins 32) inside the cooling unit 30. At this time, the plate 51 of the local transport mechanism 50 is placed in the standby position adjacent the bottom in the cooling unit 30. When the first main transport mechanism TR1 loads the wafer W on the support pins 32 in the cooling unit 30, the first main transport mechanism TR1 never contacts the plate 51 of the local transport mechanism 50 in the standby position, or the local transport mechanism 50 never obstructs the loading operation. The main transport mechanism access opening 34 of the cooling unit 30 is closed after the first main transport mechanism TR1 withdraws therefrom. The cooling unit 30 keeps the wafer W on standby. In the cooling unit 30, the wafer W is cooled, as necessary, during the standby.

Figure 12B:
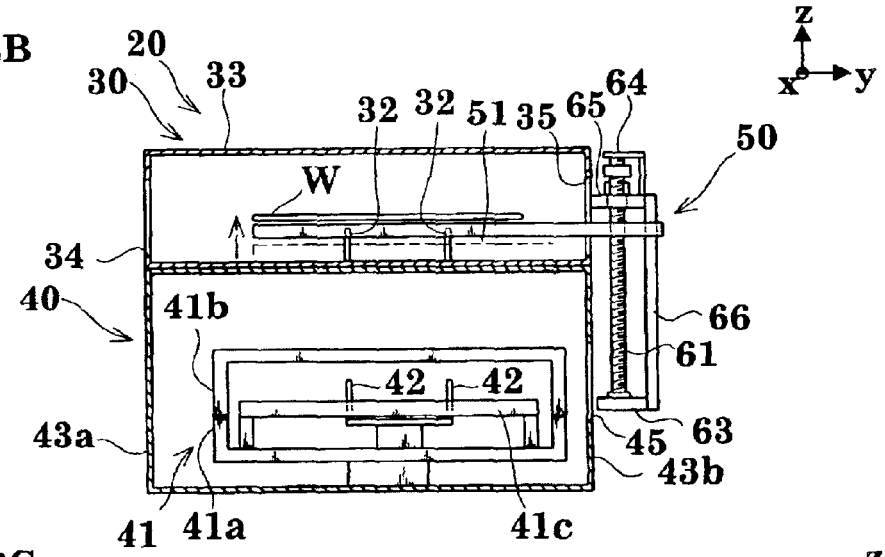
Figure 12C:
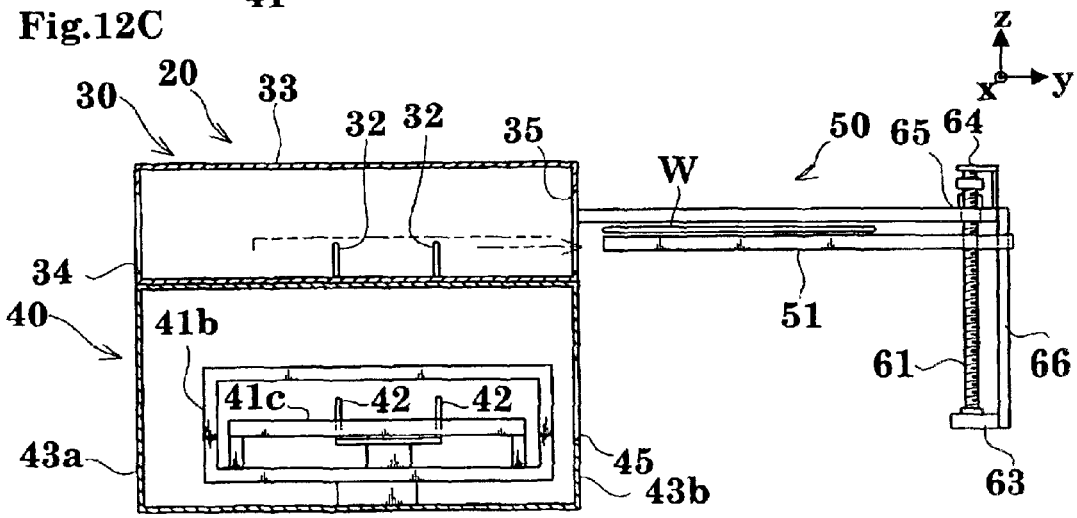

(12) Receipt of Wafer W by the Local Transport Mechanism 50:

Upon completion of the cooling treatment of the wafer W by the cooling unit 30, as shown in FIG. 12B, the vertical moving mechanism 60 of the local transport mechanism 50 is driven to raise the plate 51 and pick up the wafer W supported on the three support pins 32. Then, the local transport mechanism access opening 35 of the cooling unit 30 is opened. As shown in FIG. 12C, the horizontal moving mechanism 70 of the local transport mechanism 50 is driven to move the plate 51 in y-direction out of the cooling unit 30. After the plate 51 of the local transport mechanism 50 moves outside, the access opening 35 of the cooling unit 30 is closed.

Figure 13A:
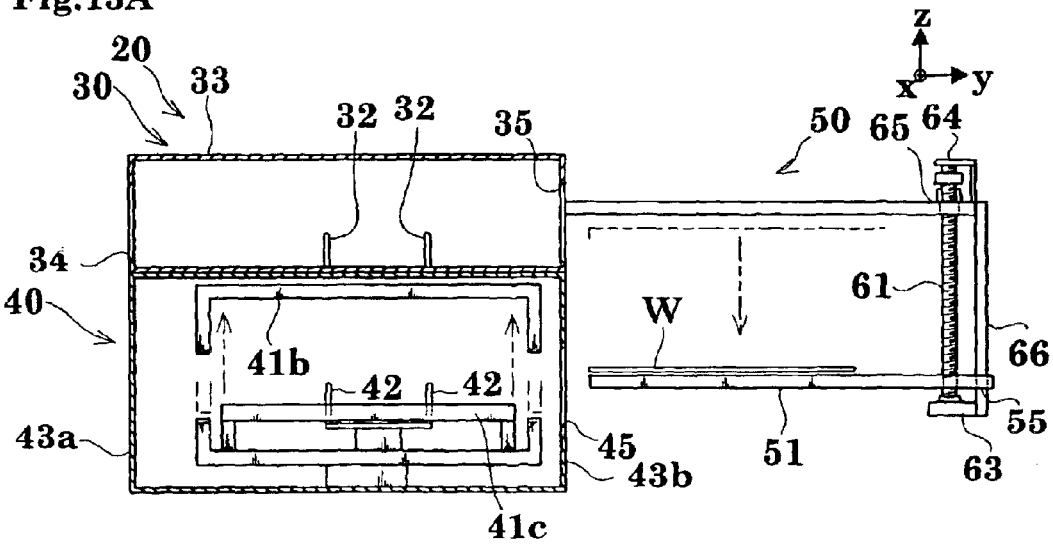
FIGS. 13A through 13C are views illustrating operation of the local transport mechanism in the heat-treating unit.
Figure 13B:
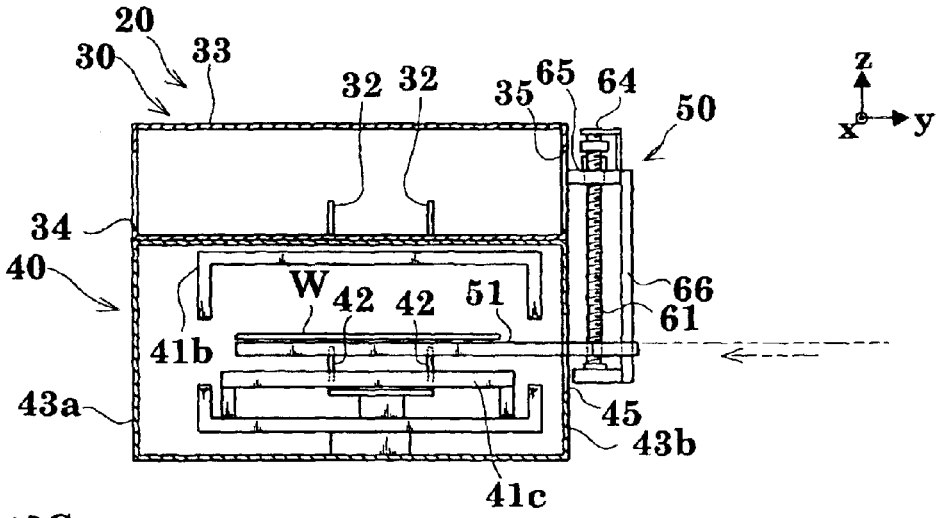
Figure 13C:
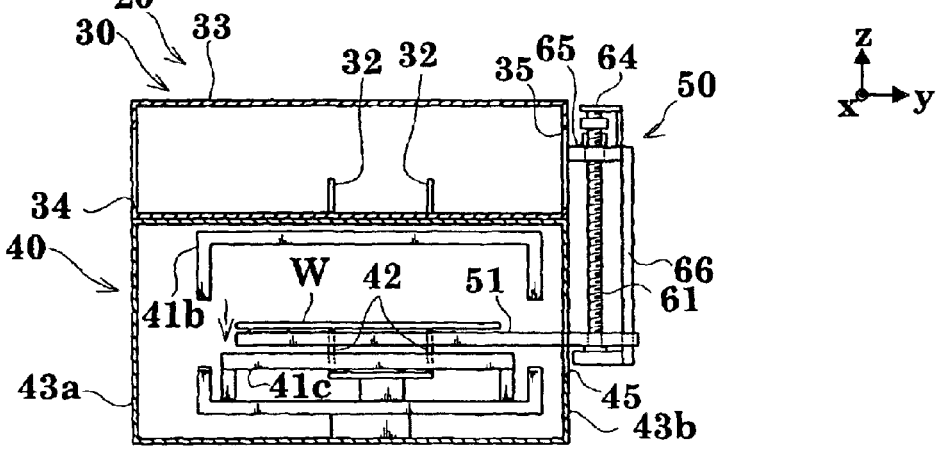

(13) Loading of Wafer W into the Heating Unit 40 by the Local Transport Mechanism 50:

As shown in FIG. 13A, the vertical moving mechanism 60 of the local transport mechanism 50 is driven to lower the plate 51 to a level for loading the wafer W into the heating unit 40. Then, the local transport mechanism access opening 45 of the heating unit 40 is opened. As shown in FIG. 13B, the horizontal moving mechanism 70 of the local transport mechanism 50 is driven to move the plate 51 in y-direction into the heating unit 40. As shown in FIG. 13C, the vertical moving mechanism 60 is driven to lower the plate 51 to a wafer delivery level to deliver the wafer W to a delivery position (e.g. on the three support pins 42) inside the heating furnace 41 of the heating unit 40. Alternatively, the support pins 42 of the heating unit 40 are raised to receive the wafer W. Then, the horizontal moving mechanism 70 is driven to withdraw the plate 51 in y-direction out of the heating unit 40. The plate 51 of the local transport mechanism 50 is further moved in an operation reversed from the foregoing operation. Ultimately, the plate 51 is placed in the standby position adjacent the bottom surface inside the cooling unit 30 as shown in FIG. 12A. The local transport mechanism access opening of the heating unit 40 is closed after the plate 51 of the local transport mechanism 50 leaves the heating unit 40.

Figure 14A:
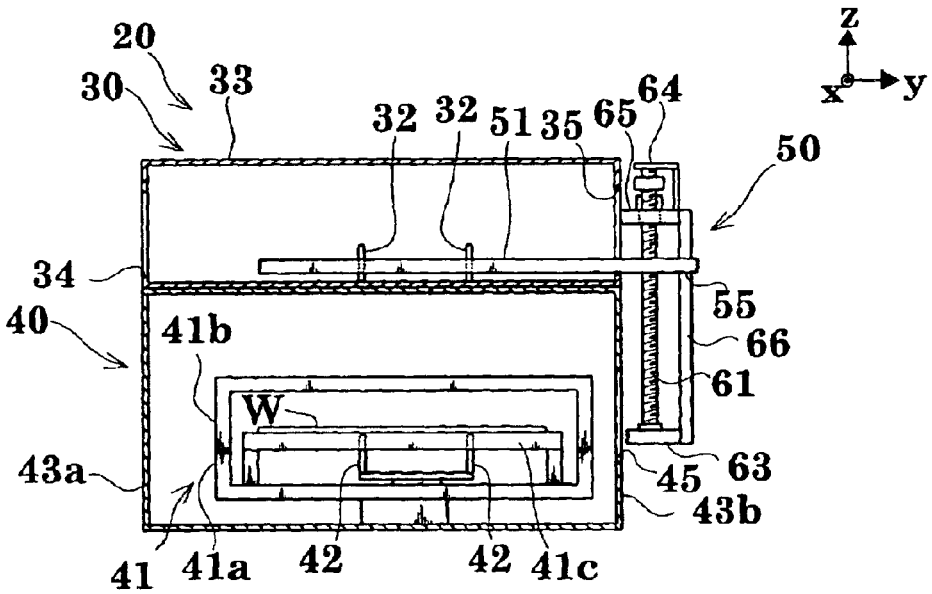
FIGS. 14A and 14B are views illustrating operation of the local transport mechanism in the heat-treating unit.
Figure 14B:
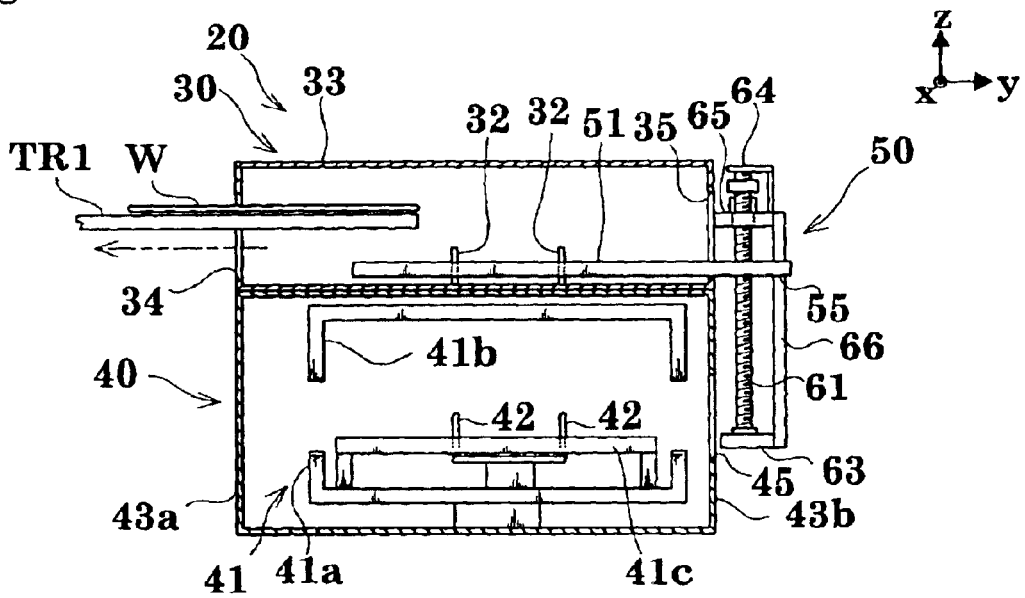

(14) Heating of Wafer W by the Heating Unit 40:

As shown in FIG. 14A, the heating furnace 41 lowers the top cover 41*b* to close the opening of the container body 41*a,* and lowers the support pins 42 to place the wafer W on the upper surface of hot plate 41*c*. In this state, the wafer W receives a predetermined heating treatment in the heating furnace 41. After the heating treatment, the heating furnace 41 raises the top cover 41*b* to open the opening of the container body 41*a,* and raises the support pins 42 to support the wafer W in a position away from the upper surface of hot plate 41*c*. As noted hereinbefore, the heating treatment may be performed to bake the wafer W after a bottom coating is formed thereon in the BARC unit, to bake the wafer W after a photoresist film is formed thereon in the SC unit, to bake the wafer W after exposure, i.e. PEB treatment, or to bake the wafer W after development.

(15) Reloading of Wafer W into the Cooling Unit 30 by the Local Transport Mechanism 50:

The plate 51 of the local transport mechanism 50 is moved from the standby position in the cooling unit 30 into the heating unit 40. The plate 51 picks up and holds the wafer W supported by the three support pins 42 raised after the heating treatment in the heating furnace 41, and transports the heated wafer W onto the three support pins 32 in the cooling unit 30. Then, the plate 51 of the local transport mechanism 50 is placed in the standby position adjacent the bottom surface inside the cooling unit 30.

(16) Unloading of Wafer W from the Cooling Unit 30 by the First Main Transport Mechanism TR1:

The main transport mechanism access opening 34 of the cooling unit 30 is opened as the first main transport mechanism TR1 approaches the access opening 34. As shown in FIG. 14B, the first main transport mechanism TR1 enters the access opening 34 of the cooling unit 30. The first main transport mechanism TR1 picks up and holds the wafer W supported by the three support pins 32 in the cooling unit 30, then withdraws from the cooling unit 30, and transports the wafer W to a predetermined different treating unit.

The operation of the first main transport mechanism TR1 for transporting the wafer W described in sections (11) and (16) above corresponds to the main transport step. The operation of the local transport mechanism 50 for transporting the wafer W described in sections (12), (13) and (14) above corresponds to the local transport step. The standby of the local transport mechanism 50 in the standby position inside the cooling unit 30 described in sections (11), (15) and (16) above corresponds to the standby step.

According to the substrate treating apparatus in the second embodiment, as described above, the local transport mechanism 50, when on standby, is placed in the standby position inside the cooling unit 30 of the heat-treating unit 20. Consequently, the local transport mechanism 50 is less influenced by the environment outside the heat-treating unit 20 than where the local transport mechanism 50 kept on standby outside the heat-treating unit 20. The local transport mechanism 50 on standby influences the environment outside the heat-treating unit 20 to a reduced degree. Variations in substrate treating precision due to such adverse influences may be reduced to perform substrate treatment with high precision. Further, temperature control of the local transport mechanism 50 may be effected easily. The local transport mechanism 50 capable of transferring wafers W between the cooling unit 30 and heating unit 40 in the heat-treating unit 20 lightens the burden on the first main transport mechanism TR1.

In the conventional substrate treating apparatus, the local transport mechanism of each heat-treating unit (heat-treating unit among the treating units 104 in FIG. 1) remains protruding from this heat-treating unit in a normal state, and temporarily enters the heat-treating unit only in time of substrate transport. The conventional substrate treating apparatus has poor maintenability since the local transport mechanism protruding from the heat-treating unit is obstructive to movement of the interface or the like. However, in the substrate treating apparatus in the second embodiment, the local transport mechanism 50 of the heat-treating unit 20 moves out of the heat-treating unit 20 only temporarily, that is only when transporting wafers W. In a normal state other than the time of transporting wafers W, the local transport mechanism 50 does not protrude from the heat-treating unit 20. Thus, the substrate treating apparatus in the second embodiment has excellent maintenability in that the interface 4 or the like may be moved without obstruction.

The cooling unit 30 has the access opening 35 for the local transport mechanism 50 separately from the access opening 34 for the first main transport mechanism TR1. This arrangement reduces the chance of interference between the local transport mechanism 50 and the first main transport mechanism TR1.

Further, the first main transport mechanism TR1 accesses only the cooling unit 30 of the heat-treating unit 20, while the local transport mechanism 50 accesses the cooling unit 30 and heating unit 40 of the heat-treating unit 20. This provides a thermal separation between the first main transport mechanism TR1 and local transport mechanism 50.

Furthermore, the first main transport mechanism TR1 accesses only the cooling unit 30 acting as a specific substrate treating section in the heat-treating unit 20. That is, the first main transport mechanism TR1 delivers a wafer W to the cooling unit 30 of the heat-treating unit 20, and takes the wafer W out of this cooling unit 30. It is unnecessary to move the heat-treating unit 20 or first main transport mechanism TR1 up and down. Thus, the heat-treating unit 20 and first main transport mechanism TR1 may have simple constructions.

This invention is not limited to the foregoing embodiments, but may be modified as follows:

(1) In the first embodiment described hereinbefore, the first main transport mechanism TR1 transports a wafer W from a different treating unit to the cooling unit 30 of the heat-treating unit 20, the local transport mechanism 50 transports the wafer W from the cooling unit 30 to the heating unit 40 of the same heat-treating unit 20, and the second main transport mechanism TR2 transports the wafer W from the heating unit 40 to a different treating unit. Conversely, the second main transport mechanism TR2 may transport the wafer W from a different unit to the heating unit 40 of the heat-treating unit 20, the local transport mechanism 50 transporting the wafer W from the heating unit 40 to the cooling unit 30 of the same heat-treating unit 20, and the first main transport mechanism TR1 transporting the wafer W from the cooling unit 30 to a different treating unit. In this case also, the standby position of the plate 51 of the local transport mechanism 50 is provided inside the cooling unit 30 as in the first embodiment. The plate 51 of the local transport mechanism 50 is placed in the standby position inside the cooling unit 30, in the normal state not transporting the wafer W from the heating unit 40 to the cooling unit 30.

(2) In the second embodiment described hereinbefore, the first main transport mechanism TR1 transports a wafer W from a different treating unit to the cooling unit 30 of the heat-treating unit 20, the local transport mechanism 50 transports the wafer W between the cooling unit 30 and heating unit 40 of the same heat-treating unit 20, and the first main transport mechanism TR1 transports the wafer W from the cooling unit 30 to a different treating unit. Conversely, the first main transport mechanism TR1 may transport the wafer W from a treating different unit to the heating unit 40 of the heat-treating unit 20, the local transport mechanism 50 transporting the wafer W between the heating unit 40 and cooling unit 30 of the same heat-treating unit 20, and the first main transport mechanism TR1 transporting the wafer W from the heating unit 40 to a different treating unit. In this case also, the standby position of the plate 51 of the local transport mechanism 50 is provided inside the cooling unit 30 as in the second embodiment. The plate 51 of the local transport mechanism 50 is placed in the standby position inside the cooling unit 30, in the normal state not transporting the wafer W between the heating unit 40 and cooling unit 30.

Figure 15:
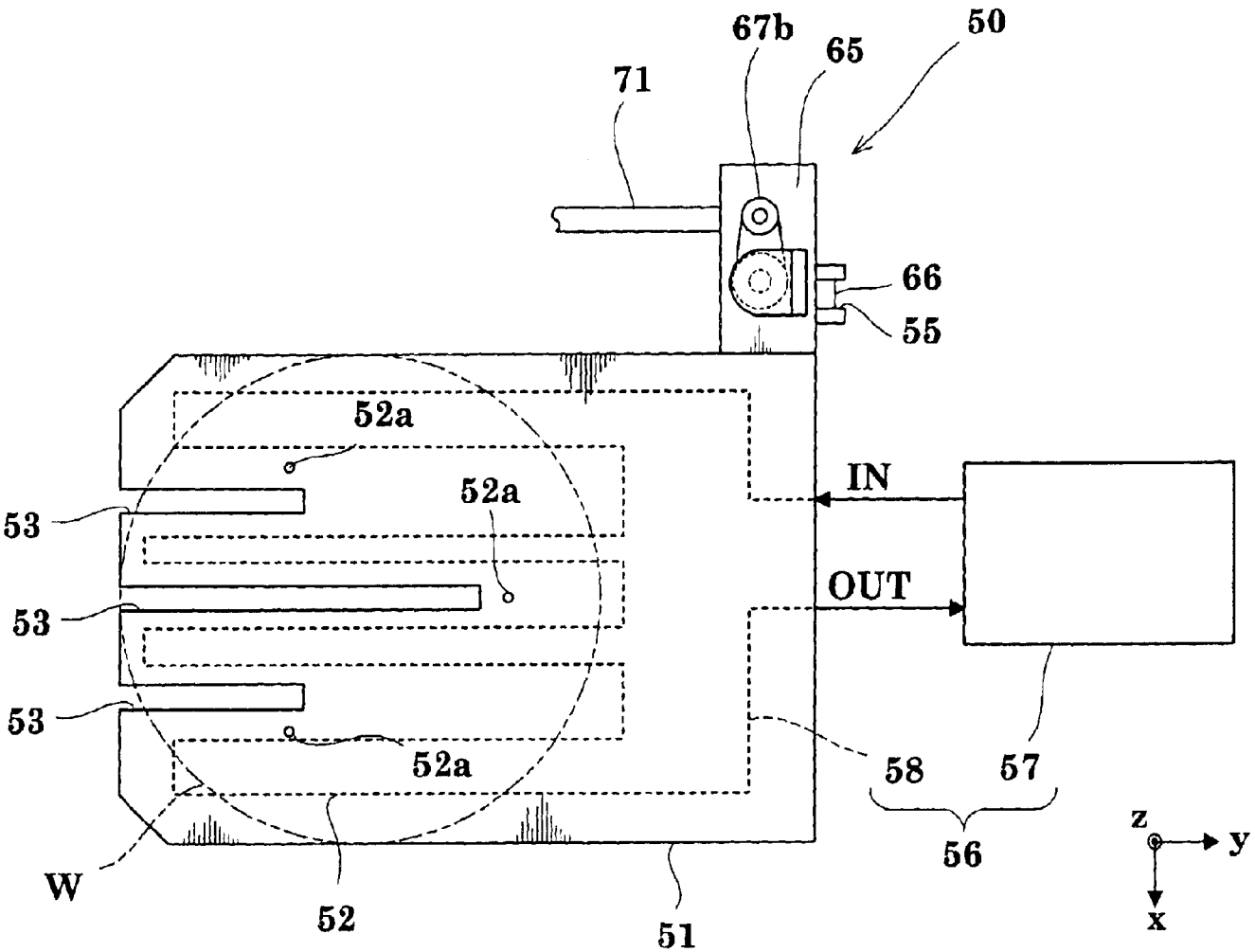
FIG. 15 is a schematic plan view of a modified local transport mechanism.

(3) The plate 51 of the local transport mechanism 50 in each of the foregoing embodiments may, as shown in FIG. 15, include a substrate cooler 56 for cooling a wafer W on the plate 51. The substrate cooler 56 has a coolant source 57 for supplying a coolant (e.g. a cooling gas or cooling liquid), and a coolant passage 58 extending along a predetermined course in the plate 51 for circulating the coolant from the coolant source 57. The substrate cooler 56 cools the wafer W supported on the plate 51. This substrate cooler 56 corresponds to the substrate cooling device of this invention. With this construction, the local transport mechanism 50 not only transports the wafer W, but can start cooling the wafer W upon receipt thereof.

(4) In each of the foregoing embodiments, the heat-treating unit 20 has the heating unit 40 disposed below the cooling unit 30. Conversely, the heat-treating unit may have the cooling unit 30 disposed below the heating unit 40.

(5) In each of the foregoing embodiments, the heat-treating unit 20 includes the cooling unit 30 and heating unit 40. Instead, the heat-treating unit may include a standby unit and the heating unit 40. The standby unit in this case has a space for keeping a substrate on standby, and effecting a natural cooling of the substrate on standby. This corresponds to the cooling unit 30 without the cooler 31 in the first and second embodiments. This standby unit corresponds to the substrate treating section and further to the substrate standby section of this invention. In this case, the local transport mechanism 50 may include the substrate cooler 56 shown in FIG. 15. Then, the local transport mechanism 50 can cool a heated substrate in the standby unit.

(6) In each of the foregoing embodiments, the cooler 31 may be driven to cool positively the plate 51 of the local transport mechanism 50 placed in the standby position inside the cooling unit 30 of the heat-treating unit 20. The above cooler 31 corresponds to the cooling device of this invention. Thus, the plate 51 of the local transport mechanism 50 may be cooled while on standby inside the cooling unit 30. The cooler 31 may be provided in the standby unit noted above, for positively cooling the plate 51 of the local transport mechanism 50 placed in the standby position inside the standby unit.

(7) In each of the foregoing embodiments, the heat-treating unit 20 includes the cooling unit 30 and heating unit 40. Instead, the heat-treating unit may include a plurality of heating units. In this case, one of the heating units provides a standby position therein for keeping the plate 51 of the local transport mechanism 50 on standby. The standby position is set so that the plate 51 of the local transport mechanism 50 on standby does not interfere with the main transport mechanism (the first main transport mechanism TR1 or second main transport mechanism TR2) accessing the heating unit.

(8) In each of the foregoing embodiments, the heat-treating unit 20 includes the cooling unit 30 and heating unit 40. Instead, the heat-treating unit may include a plurality of cooling units. In this case, one of the cooling units provides a standby position therein for keeping the plate 51 of the local transport mechanism 50 on standby, as in the first embodiment.

Figure 16:
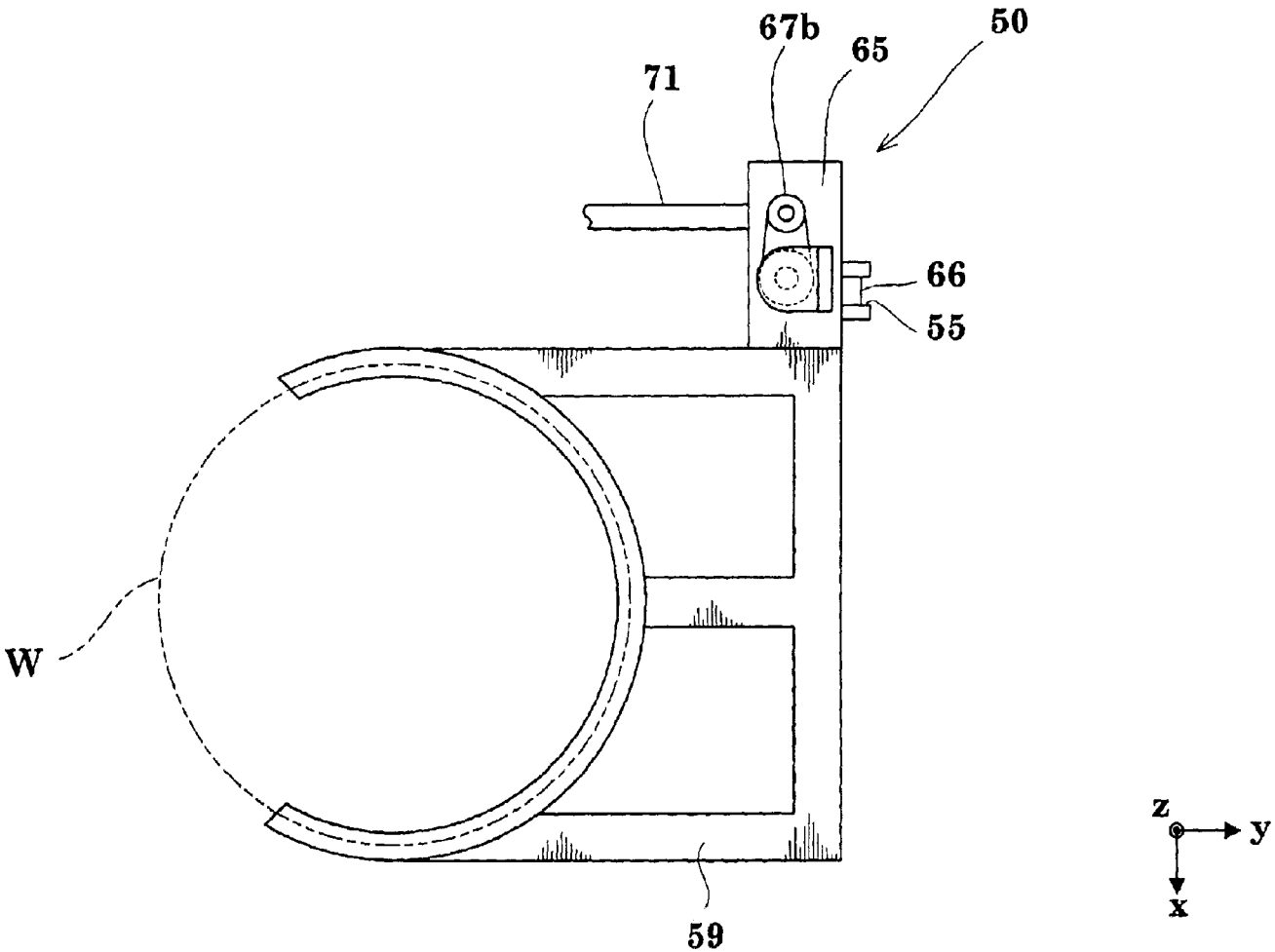
FIG. 16 is a schematic plan view of another modified local transport mechanism.

(9) In each of the foregoing embodiments and modifications, as shown in FIGS. 4 and 15, the plate 51 of the local transport mechanism 50 is placed opposite the undersurface of wafer W to support the wafer W. The invention is not limited to such substrate holding mechanism of the local transport mechanism 50. For example, the plate 51 may be replaced by an arm 59 as shown in FIG. 16, to act as the substrate holding mechanism of the local transport mechanism 50. This arm 59 includes an arcuate portion extending along the edge of a wafer W in plan view. The arm 59 holds the wafer W by supporting it at the edge thereof. In this case, the arm 59 is positioned only at the undersurface of wafer W, particularly at the edge of wafer W. Thus, the plate 51 and arm 59 in various forms may be employed as the substrate holding mechanism of the local transport mechanism 50.

(10) In each of the foregoing embodiments, substrate treatment is exemplified by resist application and development in a photolithographic process. The invention is not limited to such examples of substrate treatment. The invention is applicable to any substrate treatment performed in a usual manner on substrates such as semiconductor wafers, glass substrates for liquid crystal displays, glass substrates for photomasks, and substrates for optical disks. Such treatment may, for example, be a chemical treatment in which substrates are immersed in a treating solution and which includes cleaning and drying, an etching process of the non-immersion type (e.g. dry etching, plasma etching and so on), a cleaning treatment of the non-immersion type for cleaning substrates in a spin (e.g. sonic cleaning, chemical cleaning, and so on), chemical machine polishing (CMP), sputtering, chemical vapor deposition (CVD), or ashing.

This invention may be embodied in other specific forms without departing from the spirit or essential attributes thereof and, accordingly, reference should be made to the appended claims, rather than to the foregoing specification, as indicating the scope of the invention.

What is claimed is:

1. A substrate treating apparatus for performing a series of treatments on a substrate, comprising:

a heat-treating unit for heat-treating the substrate; and main transport means for transferring the substrate between said heat-treaing unit and a different unit;

said heat-treating unit including a plurality of substrate treating sections arranged vertically, and local transport means provided separately from said main transport means for transferring the substrate between said substrate treating sections, and standby means for placing said local transport means on standby;

wherein each of said substrate treating sections is enclosed in a housing to have an inner space for treating the substrate therein and to be shielded from an exterior of said housing;

said substrate treating sections include a substrate heating section for heating the substrate, and one of a substrate cooling section for cooling the substrate and a substrate standby section for keeping the substrate on standby; and said standby means is arranged to place said local transport means on standby in a standby position provided in one of said substrate cooling section and said substrate standby section.

2. A substrate treating apparatus as defined in claim 1, wherein at least one of said substrate treating sections has, formed separately from each other, a local transport opening for access by said local transport means, and a main transport opening for access said main transport means.

3. A substrate treating apparatus as defined in claim 2, wherein one of said substrate cooling section and said substrate standby section includes cooling means for cooling said local transport means on standby.

4. A substrate treating apparatus as defined in claim 1, wherein said substrate treating sections include at least two substrate cooling sections for cooling the substrate, one of said substrate cooling sections providing said standby position for said local transport means.

5. A substrate treating apparatus as defined in claim 1, wherein said local transport means is arranged to hold the substrate in horizontal posture, and to move the substrate in horizontal posture vertically and horizontally.

6. A substrate treating apparatus for performing a series of treatments on a substrate, comprising:

a heat-treating unit for heat-treating the substrate; and main transport means for transferring the substrate between said heat-treating unit and a different unit;

said heat-treating unit including a plurality of substrate treating sections arranged vertically, and local transport means provided separately from said main transport means for transferring the substrate between said substrate treating sections;

one of said substrate treating sections providing a standby position for said local transport means;

wherein said local transport means includes a plate member for holding the substrate, said plate member having an area for covering an undersurface of the substrate.

7. A substrate treating apparatus as defined in claim 6, wherein at least one of said substrate treating sections has, formed separately from each other, a local transport opening for access by said local transport means, and a main transport opening for access by said main transport means.

8. A substrate treating apparatus as defined in claim 7, wherein one of said substrate cooling section and said substrate standby section includes cooling means for cooling said local transport means on standby.

9. A substrate treating apparatus as defined in claim 6, wherein one of said substrate cooling section and said substrate standby section includes cooling means for cooling said local transport means on standby.

10. A substrate treating apparatus for performing a series of treatments on a substrate, comprising:

a heat-treating unit for heat-treating the substrate; and main transport means for transferring the substrate between said heat-treating unit and a different unit;

said heat-treating unit including a plurality of substrate treating sections arranged vertically, and local transport means provided separately from said main transport means for transferring the substrate between said substrate treating sections;

one of said substrate treating sections providing a standby position for said local transport means;

wherein said local transport means includes substrate cooling means for cooling the substrate held by said local transport means.

11. A substrate treating apparatus as defined in claim 10, wherein at least one for said substrate treating sections has, formed separately from each other, a local transport opening for access by said local transport means, and a main transport opening for access by said main transport means.

12. A substrate treating apparatus as defined in claim 11, wherein one of said substrate cooling section and said substrate standby section includes cooling means for cooling said local transport means on standby.

13. A substrate treating apparatus as defined in claim 10, wherein one of said substrate cooling section and said substrate standby section includes cooling means for cooling said local transport means on standby.

14. A substrate treating apparatus for performing a series of treatments on a substrate, comprising:

a heat-treating unit for heat-treating the substrate; and main transport means for transferring the substrate between said heat-treating unit and a different unit;

said heat-treating unit including a plurality of substrate treating sections arranged vertically, and local transport means provided separately from said main transport means for transferring the substrate between said substrate treating sections;

one of said substrate treating sections providing a standby position for said local transport means;

said substrate treating sections including a substrate heating section for heating the substrate, and one of a substrate cooling section for cooling the substrate and a substrate standby section for keeping the substrate on standby;

said standby position being set inside one of said substrate cooling section and said substrate standby section;

wherein said local transport means includes substrate cooling means for cooling the substrate held by said local transport means.

15. A substrate treating apparatus as defined in claim 14, wherein at least one of said substrate treating sections has, formed separately from each other, a local transport opening for access by said local transport means, and a main transport opening for access by said main transport means.

16. A substrate treating apparatus as defined in claim 15, wherein one of said substrate cooling section and said substrate standby section includes cooling means for cooling said local transport means on standby.

17. A substrate treating apparatus as defined in claim 14, wherein one of said substrate cooling section and said substrate standby section includes cooling means for cooling said local transport means on standby.

18. A substrate treating apparatus for performing a series of treatments on a substrate, comprising:

a heat-treating unit for heat-treating the substrate; and main transport means for transferring the substrate between said heat-treat unit and a different unit;

said heat-treating unit including a plurality of substrate treating sections arranged vertically, and local transport means provided separately from said main transport means for transferring the substrate between said substrate treating sections;

one of said substrate treating sections providing a standby position for said local transport means;

said substrate treating sections including a substrate heating section for heating the substrate, and one of a substrate cooling section for cooling the substrate and a substrate standby section for keeping the substrate on standby;

said standby position being set inside one of said substrate cooling section substrate standby section;

wherein one of said substrate cooling section and said substrate standby section includes cooling means for cooling said local transport means on standby.

19. A substrate treating apparatus for performing a series of treatments on a substrate, comprising:

a heat-treating unit for heat-treating the substrate; and main transport means for transferring the substrate between said heat-treaing unit and a different unit;

said heat-treating unit including a plurality of substrate treating sections arranged vertically, and local transport means provided separately from said main transport means for transferring the substrate between said substrate treating sections;

one of said substrate treating sections providing a standby position for local transport means;

wherein said substrate treating sections include at least two substrate heating sections for heating the substrate, one of said substrate heating sections providing said standby position for said local transport means.

20. A substrate treating apparatus for performing a series of treatments on a substrate, comprising:

a heat-treating unit for heat-treating the substrate; and main transport means for transferring the substrate between said heat-treaing unit and a different unit;

said heat-treating unit including a plurality of substrate treating sections arranged vertically, and local transport means provided separately from said main transport means for transferring the substrate between said substrate treating sections;

one of said substrate treating sections providing a standby position for said local transport means;

said substrate treating sections including a substrate heating section for heating the substrate, and one of a substrate cooling section for cooling the substrate and a substrate standby section for keeping the substrate on standby;

said standby position being set inside one of said substrate cooling section and said substrate standby section;

wherein said main transport means includes a first main transport mechanism for transporting the substrate to and from one of said substrate cooling section and said substrate standby section, and a second main transport mechanism for transporting the substrate to and from said substrate heating section.

* * * * *